US009994032B2

(12) United States Patent
Nakamura et al.

(10) Patent No.: US 9,994,032 B2
(45) Date of Patent: Jun. 12, 2018

(54) LIQUID CONTAINER, LIQUID CONTAINER UNIT, AND LIQUID EJECTING APPARATUS

(71) Applicant: SEIKO EPSON CORPORATION, Tokyo (JP)

(72) Inventors: Kotaro Nakamura, Nagano (JP); Shun Oya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/084,692

(22) Filed: Mar. 30, 2016

(65) Prior Publication Data

US 2016/0221348 A1 Aug. 4, 2016

Related U.S. Application Data

(63) Continuation of application No. 13/693,297, filed on Dec. 4, 2012.

(30) Foreign Application Priority Data

Dec. 8, 2011 (JP) ..... 2011-269296

(51) Int. Cl.
*B41J 2/175* (2006.01)

(52) U.S. Cl.
CPC ..... *B41J 2/1752* (2013.01); *B41J 2/175* (2013.01); *B41J 2/17506* (2013.01); *B41J 2/17509* (2013.01); *B41J 2/17513* (2013.01); *B41J 2/17526* (2013.01); *B41J 2/17553* (2013.01)

(58) Field of Classification Search
CPC ..... B41J 2/175
USPC ..... 347/85, 86
See application file for complete search history.

(56) References Cited

U.S. PATENT DOCUMENTS 4,553,865 A * 11/1985 Ikeda ..... B41J 2/255 400/124.1
5,138,344 A * 8/1992 Ujita ..... B41J 2/17513 347/14
5,156,473 A * 10/1992 Suzuki ..... B41J 2/17513 400/124.1
5,408,746 A 4/1995 Thoman et al.
(Continued)

FOREIGN PATENT DOCUMENTS

JP 07-178920 A 7/1995
JP 07-205450 A 8/1995
(Continued)

*Primary Examiner* — Matthew Luu
*Assistant Examiner* — Lily Kemathe

(57) ABSTRACT

A liquid ejecting apparatus includes a liquid tank, a tank holder, a liquid ejection head, and an apparatus casing. The liquid tank includes a liquid injection port, a liquid containing portion containing the liquid injected from the liquid injection port, and a supply port supplying the liquid. The tank holder holds the liquid tank. The liquid ejection head ejects a liquid supplied from the supply port. The apparatus casing accommodates the liquid tank, the tank holder, and the liquid ejection head. The tank holder is pivotable relative to the apparatus casing with holding the liquid tank. The liquid injection port of the liquid tank is configured to be exposed to an exterior of the apparatus casing by pivoting the tank holder relative to the apparatus casing to inject the liquid into the liquid tank, while the liquid tank is held in the tank holder.

4 Claims, 19 Drawing Sheets

(56) References Cited

U.S. PATENT DOCUMENTS 5,607,242 A * 3/1997 Suzuki ..... B41J 2/17503 347/84
5,615,957 A * 4/1997 Suzuki ..... B41J 2/17503 347/84
5,675,367 A 10/1997 Scheffelin et al.
5,812,156 A 9/1998 Bullock et al.
5,929,883 A 7/1999 Gunther et al.
5,966,156 A * 10/1999 Scheffelin ..... B41J 2/17506 347/86
6,130,695 A 10/2000 Childers et al.
6,183,077 B1 2/2001 Hmelar et al.
6,247,803 B1 * 6/2001 Kanaya ..... B41J 2/17553 347/86
6,318,850 B1 11/2001 Childers et al.
6,322,205 B1 11/2001 Childers et al.
6,345,891 B1 2/2002 Childers et al.
6,390,611 B1 5/2002 Kobayashi et al.
6,431,697 B1 8/2002 King et al.
6,443,567 B1 * 9/2002 Hayashi ..... B41J 2/17503 347/85
6,460,982 B1 10/2002 Ito et al.
6,619,789 B2 9/2003 Childers et al.
6,779,874 B2 8/2004 Sturgeon et al.
6,805,425 B2 10/2004 Hayashi et al.
6,805,434 B2 * 10/2004 Hayashi ..... B41J 2/17503 347/85
6,886,928 B2 5/2005 Sasaki et al.
7,219,428 B2 * 5/2007 Ito ..... B41J 2/14209 29/25.35
7,273,273 B2 9/2007 Calvini et al.
7,290,869 B2 * 11/2007 Hanaoka ..... B41J 2/17513 347/86
7,425,064 B2 9/2008 Koga
7,677,710 B2 3/2010 Kobayashi et al.
7,815,298 B2 10/2010 Miyazawa et al.
7,845,750 B2 * 12/2010 Kobayashi ..... B41J 2/17503 347/19
7,850,290 B2 12/2010 Nitta et al.
7,905,572 B2 * 3/2011 Anderson, Jr. ..... B41J 2/17513 347/49
8,182,077 B2 5/2012 Kanbe et al.
8,403,456 B2 * 3/2013 Kuroda ..... B41J 2/16532 347/35
8,662,661 B2 * 3/2014 Yamamoto ..... B41J 29/13 347/108
8,684,507 B2 4/2014 Uezawa
8,807,723 B2 8/2014 Aoki et al.
8,864,290 B2 * 10/2014 Osawa ..... B41J 2/175 347/108
8,899,706 B2 * 12/2014 Yabuki ..... B41J 2/1752 347/6
9,427,972 B2 * 8/2016 Kimura ..... B41J 2/1752
2001/0045977 A1 11/2001 King et al.
2002/0193526 A1 * 12/2002 Adachi ..... B05D 5/068 525/214
2003/0051904 A1 3/2003 Aruga
2003/0071874 A1 4/2003 Ishizawa et al.
2003/0184622 A1 10/2003 Sasaki et al.
2004/0017448 A1 1/2004 Murakami et al.
2004/0021737 A1 2/2004 Harada et al.
2004/0150697 A1 8/2004 Sasaki et al.
2005/0116998 A1 6/2005 Harada et al.
2005/0248637 A1 11/2005 Seine et al.
2006/0158502 A1 7/2006 Hayashi et al.
2007/0229623 A1 10/2007 Kawamura
2007/0268344 A1 * 11/2007 Anderson ..... B41J 2/17513 347/86
2007/0279464 A1 12/2007 Harazim
2009/0322836 A1 12/2009 Kanbe et al.
2010/0103231 A1 4/2010 Iwamura et al.
2010/0245459 A1 9/2010 Kanbe et al.
2011/0242236 A1 10/2011 Uezawa
2012/0038719 A1 2/2012 Shimizu et al.
2012/0044305 A1 * 2/2012 Osawa ..... B41J 2/175 347/85
2012/0044306 A1 * 2/2012 Osawa ..... B41J 2/175 347/85
2012/0251166 A1 * 10/2012 Yamamoto ..... B41J 29/13 399/110
2013/0335491 A1 * 12/2013 Osawa ..... B41J 2/175 347/86
2014/0104349 A1 * 4/2014 Kimura ..... B41J 2/17509 347/85
2015/0124028 A1 * 5/2015 Kimura ..... B41J 2/17509 347/86
2015/0283816 A1 * 10/2015 Kimura ..... B41J 2/17509 347/86
2016/0039214 A1 2/2016 Kanbe et al.

FOREIGN PATENT DOCUMENTS

JP 09-136426 A 5/1997
JP 10-114083 A 5/1998
JP 10-244685 A 9/1998
JP 2001-341488 A 12/2001
JP 2002-505212 A 2/2002
JP 2003-063038 A 3/2003
JP 3111130 U 7/2005
JP 2006-224529 A 8/2006
JP 2007-268985 A 10/2007
JP 2007-269040 A 10/2007
JP 2008-049640 A 3/2008
JP 2011-126292 A 6/2011
TW M355822 U 5/2009
TW 200950978 A 12/2009

* cited by examiner

LIQUID CONTAINER, LIQUID CONTAINER UNIT, AND LIQUID EJECTING APPARATUS

CROSS-REFERENCE TO RELATED APPLICATIONS

This is a continuation application of U.S. patent application Ser. No. 13/693,297 filed on Dec. 4, 2012, the entirety of which is incorporated herein by reference. The present application claims the priority of Japanese Patent Application No. 2011-269296, filed on 8 Dec. 2011, the entirety of which is incorporated herein by reference.

BACKGROUND

Technical Field

The present invention relates to a liquid container for containing a liquid to be supplied to a liquid ejection head for ejecting the liquid, a liquid container unit for holding the liquid container, and a liquid ejecting apparatus provided with a liquid ejection head for ejecting a liquid.

Related Art

A liquid ejecting apparatus for ejecting ink, which is one example of a liquid, from, for example, a liquid ejection head onto a sheet of paper, which is one example of a medium, to print an image, including text or graphics, has been conventionally put to practical use. This type of apparatus supplies the ink to the liquid ejecting head for ejecting the ink, from an ink cartridge (a liquid container) containing the ink, by way of connecting tubes that are connected to the cartridge. The ink thus supplied is ejected from the liquid ejection head onto the sheet of paper in association with the printing of an image.

In the liquid ejecting apparatus of such description, in order to supply ink in a continuous and stabilized manner to the liquid ejecting head in a case where a comparatively large amount is to be printed, there has been proposed a configuration in which the ink is supplied from an ink tank that contains a greater capacity of the ink than does the ink cartridge (for example, see Japanese Laid-open Patent Application 2006-24529).

It has been noted that in the liquid ejecting apparatus for carrying out a large amount of printing, it has been possible for there to arise a case where the ink does not remain in the ink tank containing the greater capacity of ink, but rather is consumed. In order to address such a case, an injection port whereby the ink can be replenished is provided to the ink tank. At this time, in a case where the ink tank is provided to the outside of a chassis of the liquid ejecting apparatus, the ink tank is at all times in an exposed state, and dust has therefore been prone to collect on the ink tank. For this reason, when the ink (the liquid) is supplemented and replenished from the injection port, there is a greater likelihood that dust will be admixed with the ink in an ink chamber capable of containing the ink within the ink tank. For this reason, the admixed dust hinders the flow of the ink, and it becomes impossible to supply the ink to the liquid ejection head in a continuous and stabilized manner via the connecting tubes.

SUMMARY

In view whereof, in order to curb the collection of dust, consideration is given to a configuration in which the ink tank is provided to the inside of the apparatus chassis of the liquid ejecting apparatus. However, in the case of the configuration of such description, because the injection port will be positioned on the inside of the apparatus chassis, it has not been easy to inject the ink from the injection port.

Having been contrived in order to resolve the foregoing problems, the present invention has the primary objective of providing a liquid container, liquid container unit, and liquid ejecting apparatus whereby a liquid can be easily made to flow into a liquid containing portion from an injection port.

A liquid ejecting apparatus according to one aspect includes a liquid tank, a tank holder, a liquid ejection head, and an apparatus casing. The liquid tank includes a liquid injection port, a liquid containing portion containing the liquid injected from the liquid injection port, and a supply port supplying the liquid. The tank holder holds the liquid tank. The liquid ejection head ejects a liquid supplied from the supply port. The apparatus casing accommodates the liquid tank, the tank holder, and the liquid ejection head. The tank holder is pivotable relative to the apparatus casing with holding the liquid tank. The liquid injection port of the liquid tank is configured to be exposed to an exterior of the apparatus casing by pivoting the tank holder relative to the apparatus casing to inject the liquid into the liquid tank, while the liquid tank is held in the tank holder.

A liquid ejection apparatus according to another aspect includes a liquid tank, a liquid ejection head, and a tank holder. The liquid tank includes a first portion having a liquid injection port, and a second portion having a liquid containing portion containing liquid introduced from the liquid inlet, and having a supply port supplying the liquid. The liquid ejection head ejects the liquid supplied from the supply port. The tank holder holds the liquid tank. The liquid tank is displaceable relative to the tank holder. The first portion is configured to be exposed to an exterior of the tank holder by displacing the liquid tank relative to the tank holder to inject the liquid into the liquid tank, while the second portion is held in the tank holder.

A liquid ejection apparatus according to another aspect includes a liquid tank, a liquid ejection head and a tank holder. The liquid tank includes a first member having a liquid injection port, and a second member having a liquid containing portion containing liquid introduced from the liquid inlet, and having a supply port supplying the liquid. The liquid ejection head ejects the liquid supplied from the supply port. The tank holder holds the liquid tank. The first member is displaceable relative to the second member. The first member is configured to be exposed to an exterior of the tank holder by displacing the first member relative to the second member to inject the liquid into the liquid tank, while the second member is held in the tank holder.

BRIEF DESCRIPTION OF THE DRAWINGS

FIG. 13A is a side view illustrating a configuration in a case where an ink tank moves in the horizontal direction, FIG. 13B is a partially enlarged view illustrating a configuration of a positioning mechanism, and FIG. 13C is a side view illustrating a configuration in a case where an ink tank moves in the vertical direction;

FIG. 17A is a side view illustrating a case where a plurality of members move in the same direction, and FIG. 17B is a side view illustrating a case where a plurality of members move in different directions;

FIG. 18A is a side view illustrating a case where a plurality of members are extended in the same direction, and FIG. 18B is a side view illustrating a case where a single member is extended and moved;

FIG. 19A is a perspective view illustrating a state where an injection port is not exposed, FIG. 19B is a perspective view illustrating a state where an injection port is exposed by a rotational movement, and FIG. 19C is a perspective view illustrating a state where an injection port is exposed by a linear movement; FIG. 20A is a side view illustrating an ink chamber formed so as to correspond to an injection port, FIG. 20B is a side view illustrating an ink tank in which a first portion comprising a plurality of injection ports is able to move in a relative manner with respect to a second portion which is different than the first portion and includes an ink chamber, within the ink tank, and FIG. 20C is a perspective view illustrating an ink tank in which a plurality of injection ports are arranged side by side in a direction that intersects with a movement direction within a first portion.

DISCLOSURE OF THE EMBODIMENTS

Described below, as one example of a liquid ejecting apparatus and with reference to the accompanying drawings, is a multifunctional peripheral provided with an image read device for reading an image, wherein the multifunction peripheral is an inkjet-type printer (a first embodiment) serving as one embodiment of a liquid ejecting apparatus for printing an image or the like while also ejecting ink, which is one example of a liquid, onto a sheet of paper, which is one example of a medium. Next, with reference to the accompanying drawings, there shall be described one embodiment of a liquid container unit (a second embodiment) provided with: a liquid container having an injection port for ink that is to be supplied to a liquid ejection unit of a printer, and a liquid containing portion capable of containing injected ink; and a container holder capable of holding the liquid container. Thereafter, with reference to the accompany drawings, there shall be described one embodiment of a liquid container (a third embodiment) to which are provided an injection port for ink and a liquid containing portion capable of containing ink injected from the injection port.

First Embodiment

Figure 1:
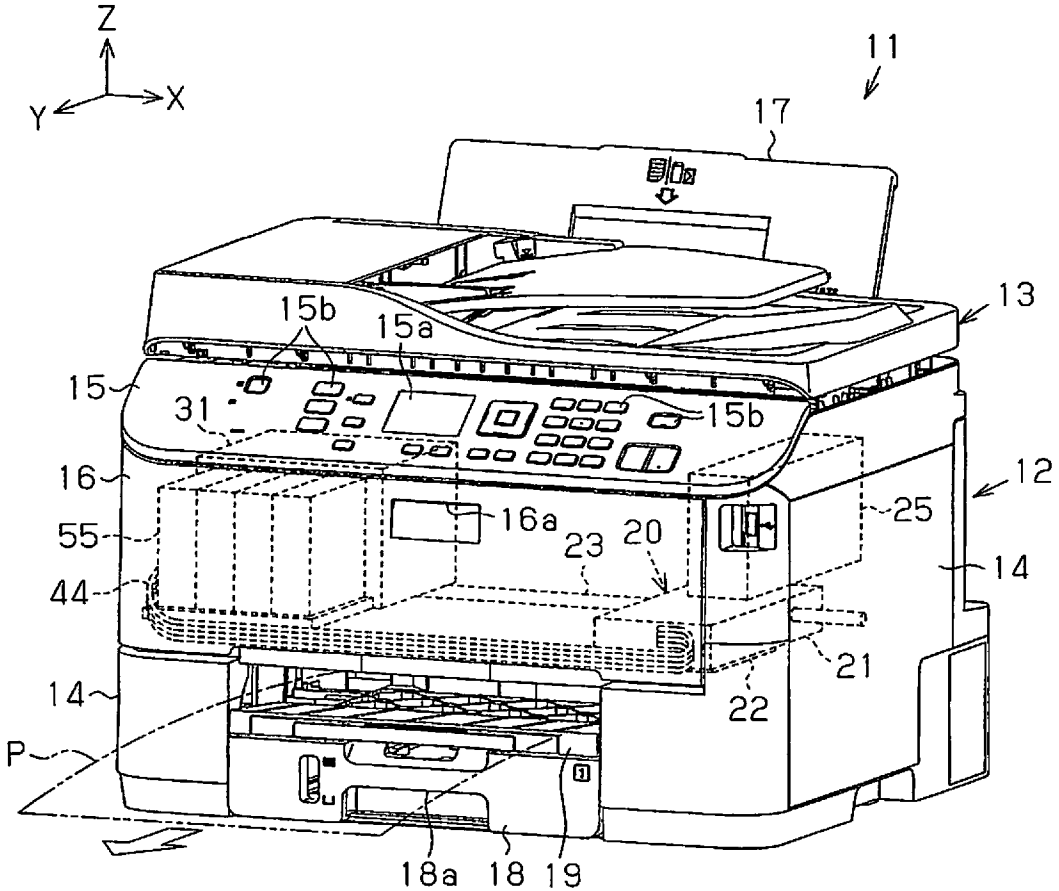
FIG. 1 is a perspective view illustrating a printer of an embodiment.

As illustrating in FIG. 1, a printer 11 is constituted of an apparatus body 12, and a scanner unit 13 serving as an image read device installed on the apparatus body 12 by being connected thereto on the side opposite to the direction of gravity (the upward side) in the vertical direction Z. The apparatus body 12 is constituted of an apparatus case 14, which is one example of a chassis, of the printer 11, which is constituted of a plurality of members; a liquid ejection unit 20 for ejecting ink onto a sheet of paper P is provided within a spatial region enclosed by the apparatus case 14.

Arranged on the apparatus case 14 is an operation panel 15 which is operated by a user when the printer 11 is being manipulated, on an upper side in the front direction, which serves as a discharge direction Y for a sheet of paper P that is printed. The operation panel 15 is provided with a display unit (for example, a liquid crystal display) 15*a* for displaying a menu screen and the like, and a variety of operation buttons 15*b* provided around the display unit 15*a*. Through operation of the operation buttons 15*b*, an ejection action of the liquid ejection unit 20 is manipulated and an image or the like is printed.

A front cover 16, serving as one apparatus case 14, is attached so as to be openable and closable on a lower side of the operation panel 15 on the apparatus case 14. The front cover 16 is provided so as to cover an opening part formed on a front side of the apparatus case 14, and is given a configuration for opening forward by pivoting about a rotating shaft 16J (see FIG. 5) provided therebelow. Provided as a recession in the front cover 16 is a holding unit 16*a* for the user to place a hand therein when opening or closing the front cover 16. A paper discharge tray 19 for discharging to the outside of the apparatus body 12 a sheet of paper P being discharged from the apparatus body 12 is disposed below the front cover 16 in the apparatus case 14.

In the printer 11, a paper feed cassette 18 on which sheets of paper are placed in a stacked state is provided to the lower side of the paper discharge tray 19; the sheet of paper at the uppermost stacking position contained therein is fed, one sheet at a time, on a conveyance route (not shown) formed within the apparatus body 12 and is conveyed toward the liquid ejection unit 20. The paper feed cassette 18 can be inserted into or pulled out from the apparatus body 12; an eaves-shaped holding unit 18*a* for the user to place a hand therein when pulling the paper feed cassette 18 out from the apparatus body 12 is formed on a front side thereof, thus facilitating pulling out of the paper feed cassette 18 forward from the apparatus body 12. A placement tray 17 for placing a sheet of paper thereon is provided on a rear side of the apparatus body 12; a sheet of paper P that is placed on the placement tray 17 is fed on a conveyance route (not shown) identically formed within the apparatus body 12 and conveyed toward the liquid ejection unit 20.

In the present embodiment, the liquid ejection unit 20 is configured to have a carriage 21 and a liquid ejection head 22. More specifically, a guide shaft 23 that extends along a width direction X, which intersects with the discharge direction Y of the sheet of paper P, is built within the apparatus case 14. The carriage 21 is supported by the guide shaft 23 in a state of being able to move along the width direction X. The carriage 21 has a part that is fixed to a belt for moving in association with driving by a carriage motor (not shown), and moves reciprocatingly together with the movement of the belt, with the width direction X serving as a scanning direction. The liquid ejection head 22 for ejecting onto the sheet of paper P ink serving as one example of a liquid is supported on a lower surface side of the carriage 21.

A board unit 25 having, inter alia, drive circuitry for driving so as to move the carriage 21 and thereby move the liquid ejection head 22 and so as to eject ink from the moving liquid ejection head 22 is disposed on a right-side end part as seen from the front of a movement region that runs along the width direction X of the carriage 21. Meanwhile, on the left-side end part as seen from the front of the movement region running along the width direction X of the carriage 21, there are disposed a plurality (in the present embodiment, four) of ink-containing ink cartridges 55, which are one example of liquid containers, for supplying the ink to the liquid ejection unit 20 (the liquid ejection head 22). Also provided are a cartridge holder 31, which is one example of a container holder, for detachably attaching the ink cartridges 55, and ink supply tubes 44, which are one example of liquid supply members, for supplying ink from the cartridge holder 31 side toward the carriage 21 side. By inserting or pulling out an ink cartridge while same is being guided by a guide unit 31*a* (see FIG. 2) in a state where the front cover 16 is open, it is possible to attach or detach an ink cartridge 55 onto or from the cartridge holder 31.

Figure 2:
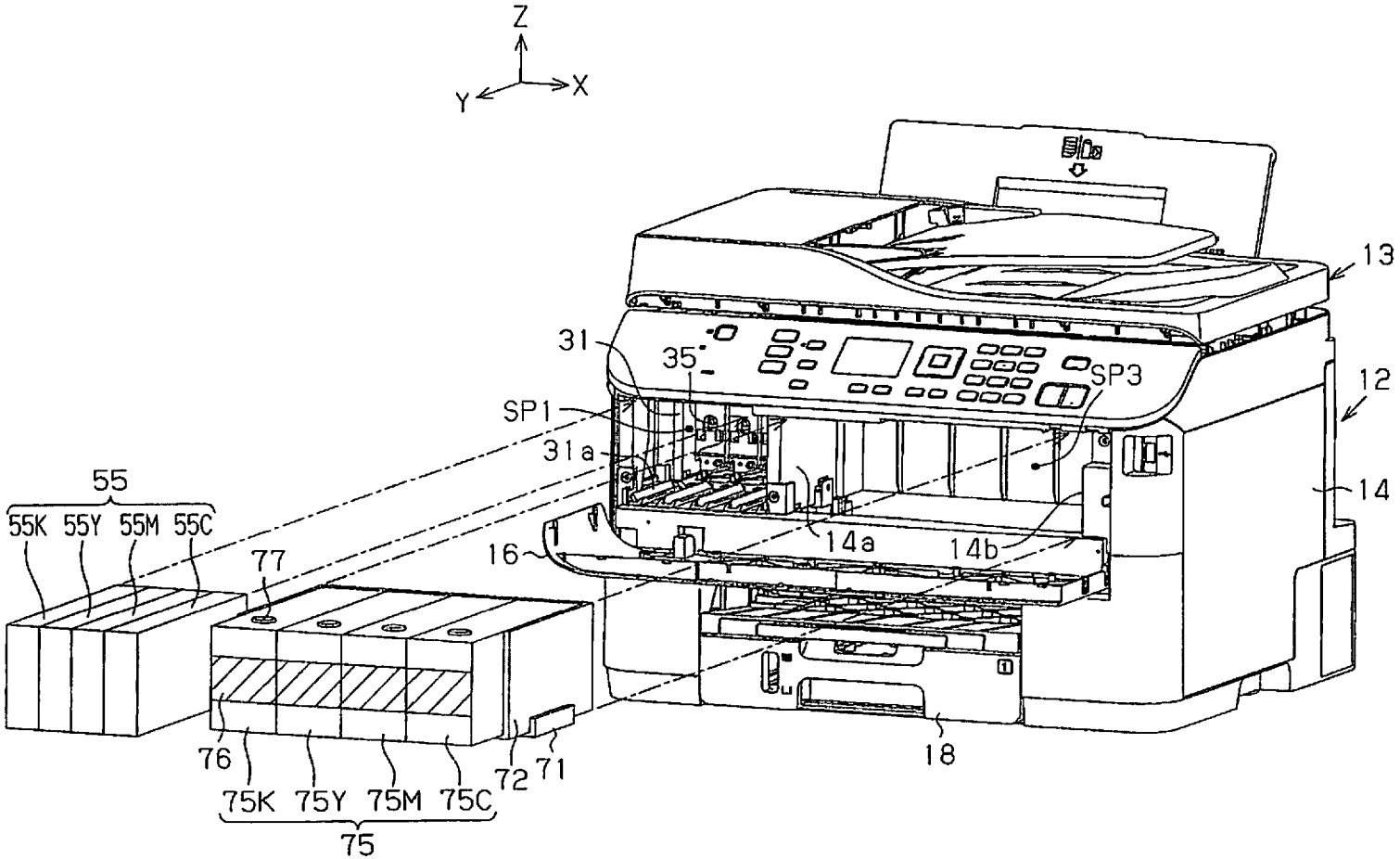
FIG. 2 is a perspective view illustrating a configuration of the same printer in a state where a front cover is opened.

As illustrated in FIG. 2, within the printer 11 having the configuration of such description, a first spatial part SP1 faced by supply needles 35 serving as supply members for supplying the ink to the liquid ejection unit 20 is provided inside a spatial region enclosed by the apparatus 14 comprising the front cover 16, which is one example of a cover member for covering an opening part at the front side thereof. The first spatial part SP1 is formed as a spatial region within which the cartridge holder 31 is arranged and the ink cartridges 55 are inserted and attached. A case wall part 14*a* serving as one part of the apparatus case 14 and a case wall part 14*b* serving as one part of the apparatus case 14 are provided to the right side of the spatial region of the first spatial part SP1 and to the left side of the board unit 25, respectively. Between the case wall part 14*a* and the case wall part 14*b*, a second spatial part SP3 is provided within a spatial region enclosed by the apparatus case 14 comprising the front cover 16, which covers an opening part on the front side thereof.

In the present embodiment, the second spatial part SP3 is provided at a position at which the liquid ejection unit 20 will not interfere with an occupied spatial region that is occupied during an operation for ejecting ink (print operations and the like), and possesses a larger spatial region than the first spatial part SP1. In the second spatial part SP3, ink tanks 75, which are one example of liquid containers, having injection ports 77 through which the ink can be injected are inserted, for example as illustrated by the arrow of the dashed lines in FIG. 2, and contained within the second spatial part SP3. In this manner, opening parts formed on the front side of the apparatus cover 14 are provided so as to correspond to the ink cartridges 55 and the ink tanks 75.

In the present embodiment, the ink tanks 75 are provided with a greater containment capacity than that of the ink cartridges 55, and are disposed containing ink identical to the ink contained in ink cartridges 55C, 55M, 55Y, 55K. More specifically, the ink tanks 75 encompass four ink cartridges 75C, 75M, 75Y, 75K, which are one example of liquid containers in which inks of each color, i.e., cyan, magenta, yellow, and black, respectively, are contained. The four ink tanks 75C, 75M, 75Y, 75K are formed in either a separated or integrated fashion.

In each of the ink tanks 75C, 75M, 75Y, 75K, the injection ports 77 for injecting ink, for example, when ink is being replenished, in a state where the ink tanks are contained and disposed in the second spatial part SP3 are provided to an upper surface, which is on a side opposite to the direction of gravity, being the vertical direction Z, which intersects with both the width direction X and the discharge direction Y. The injection ports 77 are ordinarily closed off by a cover (not shown), and are uncovered when ink is to be injected. On each of the ink tanks 75C, 75M, 75Y, 75K, labels 76 for displaying the color or type of ink contained or the like (the hatched portions) are pasted onto the front surface, which is the front cover 16 side, in a state where the ink tanks are disposed in the second spatial part SP3. In the description hereinbelow, the name "ink tanks 75" is used in cases where no distinction is being made between the ink tanks 75C, 75M, 75Y, 75K.

The ink tanks 75 are received and held by a tank holder 72, while the tank holder 72 is in turn supported by a holder support stand 71. The left and right ends of the holder support stand 71 are fixed to the apparatus case 14 (for example, to the case wall part 14*a* and the case wall part 14*b*) of the printer 11. As such, in the printer 11, the tank holder 72 is attached in a state of being supported by the holder support stand 71 to which the left and right ends thereof are fixed, within the second spatial part SP3, whereby the ink tanks 75 are contained within the second spatial part SP3, i.e., within the spatial region enclosed by the apparatus case 14. As a result, the holder support stand 71 and the ink holder 72 function as a container holder for holding the ink tanks 75.

The holder support stand 71 is removably fixed to the apparatus case 14; removal, for example during maintenance of the liquid ejection unit 20 or the like, makes it possible to make use of the second spatial part SP3 to carry out maintenance processes, such as for handling a jam of the sheets of paper P.

As a result, the printer 11 is provided with a liquid supply system EKS for supplying ink to the liquid ejection unit 20 from the ink tanks 75 contained in the second spatial part SP3, in a state where the ink cartridges 55C, 55M, 55Y, 55K are not attached. The liquid supply system EKS shall be described with reference to FIGS. 3 and 4. To facilitate the description, FIGS. 3 and 4 schematically depict only the required constituent elements.

Figure 3:
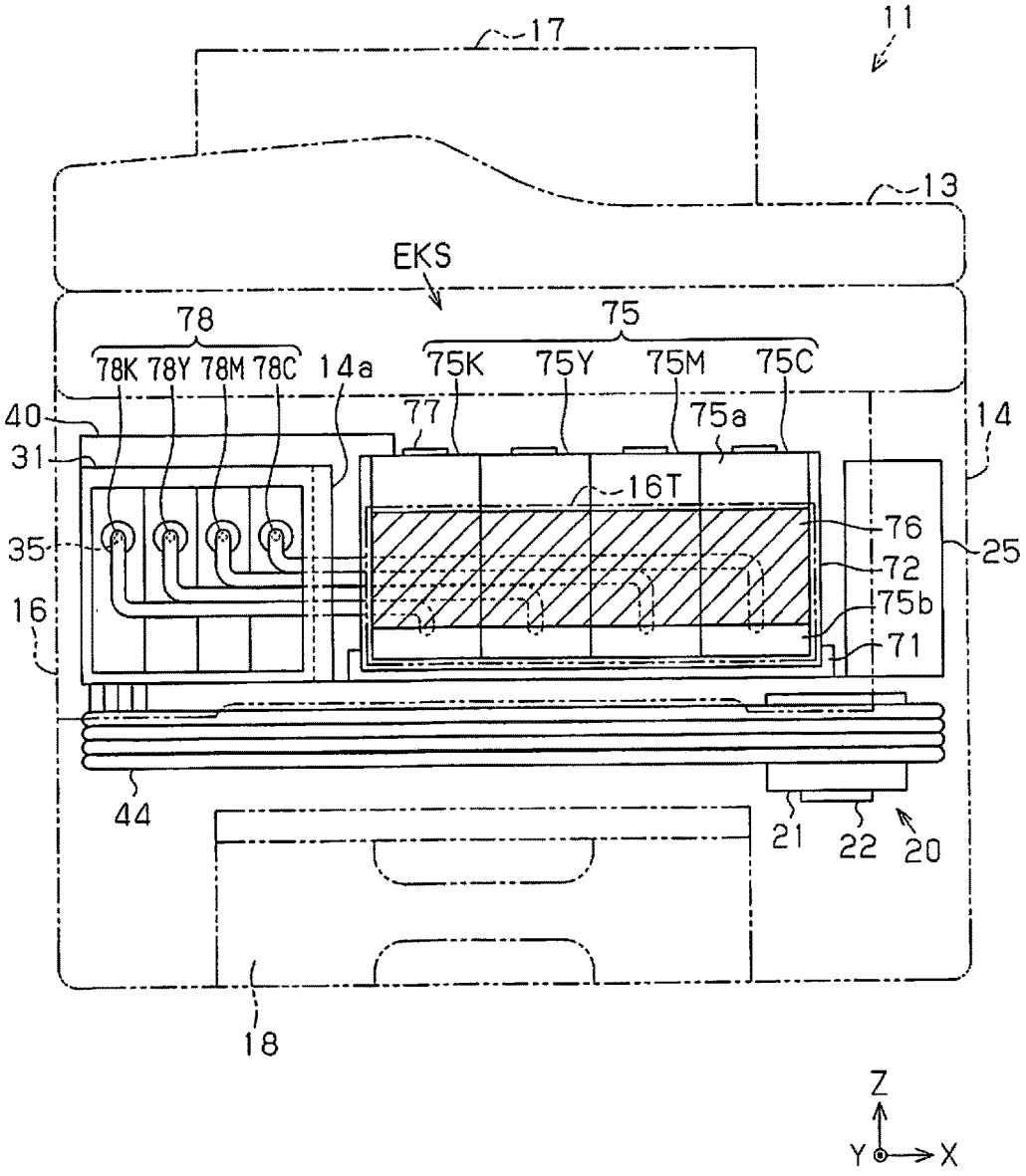
FIG. 3 is a front view schematically illustrating a configuration of a liquid supply system provided to a printer.
Figure 4:
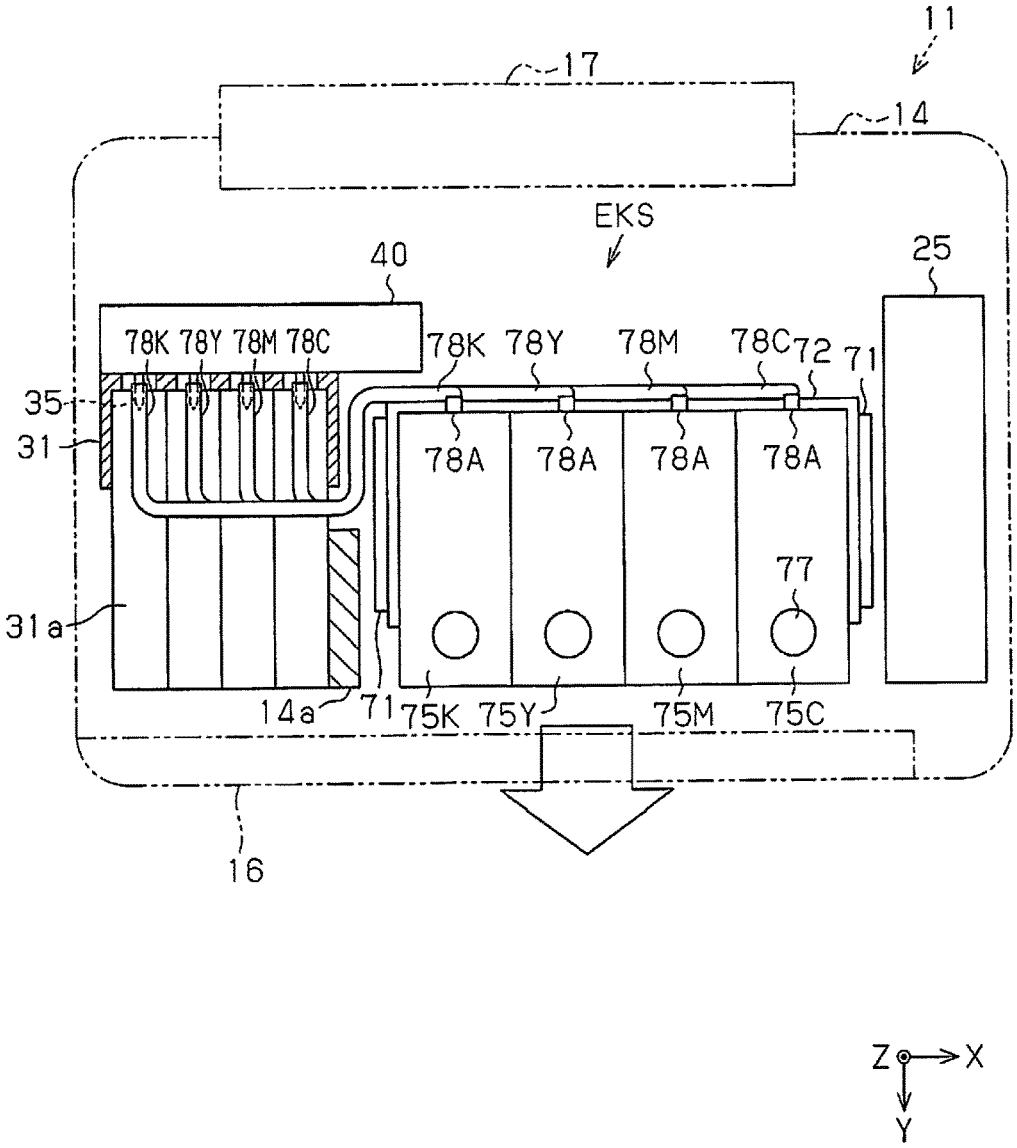
FIG. 4 is a plan view schematically illustrating a configuration of a liquid supply system provided to a printer.

As illustrated in FIGS. 3 and 4, the liquid supply system EKS provided to the printer 11 supplies to the liquid ejection unit 20 the ink contained in each of the ink tanks 75C, 75M, 75Y, 75K. More specifically, each of the ink tanks 75C, 75M, 75Y, 75K is connected to the supply needles 35 by connecting tubes 78C, 78M, 78Y, 78K, which are one example of liquid supply members that are elastically deformable. In the present embodiment, the connecting tubes 78C, 78M, 78Y, 78K (the name "connecting tubes 78" is used for cases where same are referred to collectively) each have one end which is connected to supply ports 78A provided to the rear surface sides of the ink tanks 75 and another end which passes through a gap between the cartridge holder 31 and the case wall part 14*a* and is connected to a supply needle 35. The connection with the connecting tubes 78 allows for the ink contained in the ink tanks 75 to be supplied to the supply needles 35.

The ink supplied to the supply needles 35 is supplied to the ink supply tubes 44 by a flow path formation unit 40, functioning as a liquid flowing means, disposed behind the cartridge holder 31. More specifically, the flow path formation unit 40 is provided with flow routes for ink, connected in a state where one side communicates with the supply needle 35 disposed on the front thereof and where the other side communicates with an ink supply tube 44. The flow routes are provided with a diaphragm pump, check valve, and the like (not shown). Also, for example, operation of the diaphragm pump in response to a drive signal from the board unit 25 forcibly causes each of the inks to flow while also forming a flow direction for the ink in which the supply needle 35 is the upstream side of the flow route and the ink supply tube 44 is the downstream side. As a consequence thereof, the flow path formation unit 40 is positioned on the downstream side of the flow direction for ink oriented toward the liquid ejection unit 20 from the supply needles 35, and supplies each of the inks to the liquid ejection unit 20 from the ink tanks 75 via the ink supply tubes 44, irrespective of the positions at which the ink tanks 75 are disposed within the second spatial part SP3.

In the liquid supply system EKS, the labels 76 pasted to the front of the ink tanks 75 are pasted at the upper side and/or lower side thereof, so that the member surfaces of the ink tanks 75 are exposed. In the present embodiment, the labels 76 are pasted onto the ink tanks 75 so that both an upper surface 75*a* and a lower surface 75*b* thereof are exposed. The upper surface 75*a* and the lower surface 75*b* are formed of a translucent (or semi-translucent) member whereby the inks contained in the ink tanks 75 can be viewed, at least in part.

A see-through region 16T whereby the label 76 and/or the upper surface 75*a* and/or the lower surface 75*b* can be viewed in a closed state is formed as a viewing part on the front cover 16 constituting the chassis of the printer 11. In the present embodiment, the see-through region 16T is an opening hole provided to the front cover 16, and it is possible to view the lower surfaces 75*b* and the labels 76 of each of the ink tanks 75C, 75M, 75Y, 75K. The see-through region 16T may also be formed of a translucent material (or a semi-translucent material).

Then, in the present embodiment, within the printer 11, the ink tanks 75 disposed inside the second spatial part SP3 are enabled to move from a state of being disposed inside the printer 11 to the front, serving as the discharge direction Y, as is illustrated by the white arrow in FIG. 4. More specifically, a movement mechanism for moving the ink tanks 75 so that the injection ports 77 are positioned on the outside of the region of the second spatial part SP3 is provided. Working examples (first through fifth working examples) of this movement mechanism shall now be described, with reference to FIGS. 5 to 9.

In the present embodiment, the movement mechanism displaces the ink tanks 75 from the inside of the apparatus case 14 to the outside of the apparatus case 14, via the opening part, so that a first portion comprising at least the injection ports 77 is positioned more forward than the front cover 16.

First Working Example of the Movement Mechanism

Figure 5:
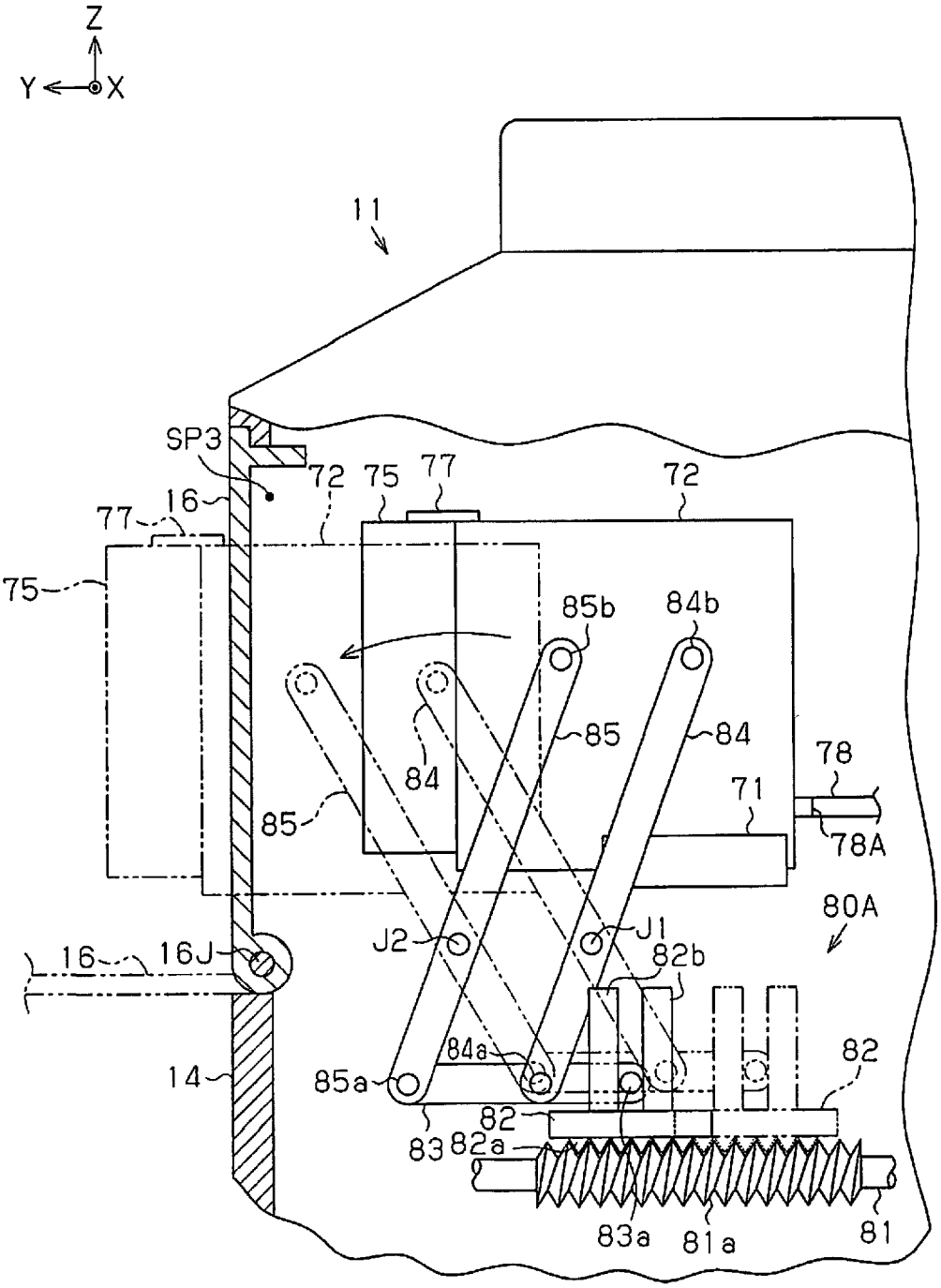
FIG. 5 is a configuration diagram of a movement mechanism of an ink tank, the movement mechanism moving an injection port to the outside of an apparatus case.

As illustrated in FIG. 5, a movement mechanism 80A of the present working example has: a rotating shaft 81, a helical screw 81*a* being provided to the outer periphery; and a slide member 82 to which are provided rack teeth 82*a* for meshed engagement with the helical screw 81*a* and two columnar parts 82*b* erected so as to have a predetermined spacing therebetween. The movement mechanism 80A also has rod-shaped link members 83, 84, 85 for constituting a link mechanism. More specifically, provided are the link member 84, which rotates about a fixed shaft J1 fixed to the apparatus case 14 or the like, and the link member 85, which identically rotates about a fixed shaft J2 fixed to the apparatus case 14 or the like. The fixed shafts J1, J2 are provided at a predetermined spacing in the front-rear direction. Further provided is the link member 83, which is interconnected between a rotating shaft 84*a* provided to one end of the link member 84 and a rotating shaft 85*a* provided to one end of the link member 85. The rotating shafts 84*a*, 85*a* are provided to positions for rotating while maintaining the state where the link member 84 and the link 85 are in parallel with each other when the link member 83 is moved in the front-rear direction.

On the link member 83, a projecting part 83*a* is provided to one end thereof (herein, the rear end), the projecting part 83*a* being arranged so as to be positioned between the two columnar parts 82*b* of the slide member 82, so as to move in company with the slide member 82. On the link member 84, a rotating shaft 84*b* is provided at an end part on the opposite side to the side where the link member 83 is interconnected, the rotating shaft 84*b* being interconnected with the tank holder 72. Identically, on the link member 85, a rotating shaft 85*b* is provided at an end part on the opposite side to the side where the link member 83 is interconnected, the rotating shaft 84*b* being interconnected with the tank holder 72.

In the movement mechanism 80A of the present working example, the rotating shaft 81 is rotated by a drive source (not shown) driven either automatically or due to a manual operation by the user in an uncovered state where the front cover 16 opens on the opening part, whereby the slide member 82 is moved back and forth. As such, as illustrated by the solid lines and the double-dashed lines in FIG. 5, the slide member 82 moves from the front toward the back, whereby the link mechanism operates and moves the tank holder 72 forward. The first portion, comprising the injection ports 77, in the ink tanks 75 is thereby displaced from the inside of the apparatus case 14 to the outside of the apparatus case 14, via the opening part. The movement mechanism 80A of the present working example is thus configured.

Second Working Example of the Movement Mechanism

Figure 6:
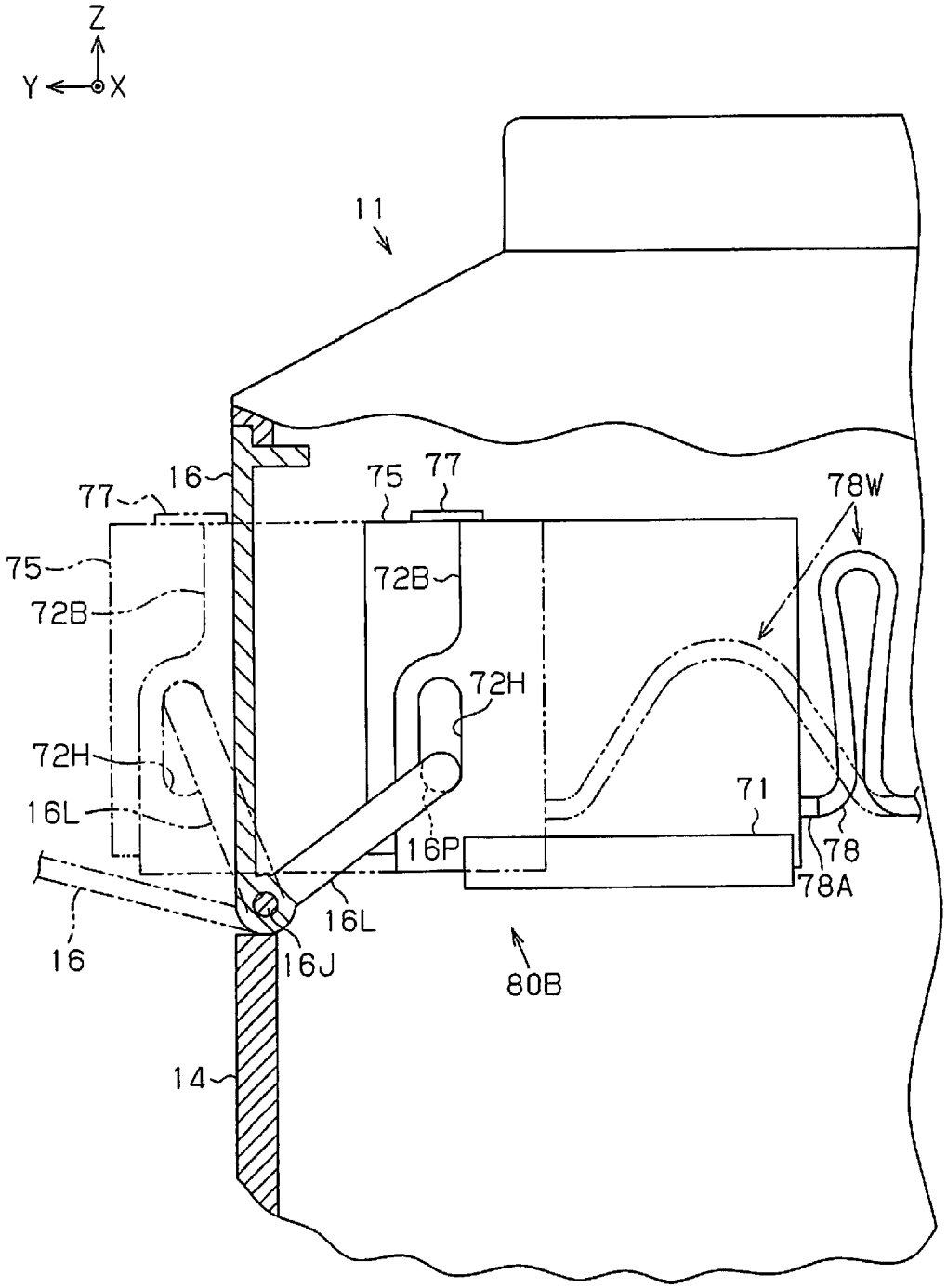
FIG. 6 is a side view schematically illustrating a configuration of a movement mechanism for moving an ink tank in conjunction with a front cover.

As illustrated in FIG. 6, a movement mechanism 80B of the present working example has: a lever member 16L which rotates integrally with the front cover 16 about the rotating shaft 16J, and to which a round pin 16P is provided at an end part on the opposite side from the rotating shaft 16J; and a tank holder 72B to which is provided an engagement hole 72H for engaging with the round pin 16P at a front end part.

In the movement mechanism 80B of the present working example, in association with being moved by a manual operation by the user to the uncovered state where the front cover 16 opens on the opening part, the lever member 16L pivots about the rotating shaft 16J and, as illustrated by the solid lines and the double-dashed lines in FIG. 6, moves from back to front. By rotating to move as far as a position at which the front cover 16 adopts the uncovered state, the lever member 16L causes the engagement hole 72H that engages with the round pin 16P to move forward. As a result, the tank holder 72B moves forward, and the first portion comprising the injection ports 77 in the ink tanks 75 is displaced from the inside of the apparatus case 14 to the outside of the apparatus case 14. The front and rear of the displaced tank holder 72B are supported from below by the round pin 16P and by the holder support stand 71, respectively. The movement mechanism 80B of the present working example is thus configured.

In the present working example, tubes that are elastically deformable are employed for the connecting tubes 78 connected to the supply ports 78A of the ink tanks 75, forming at least in part a curved part 78W that is curved in a natural state, i.e., a state in which substantially no stress is being applied. As such, as illustrated by the solid lines and the double-dashed lines in FIG. 6, the connecting tubes 78 are enabled to be displaced in a state where little stress is generated in association with the movement of the ink tanks 75 from back to forward.

Third Working Example of the Movement Mechanism

Figure 7:
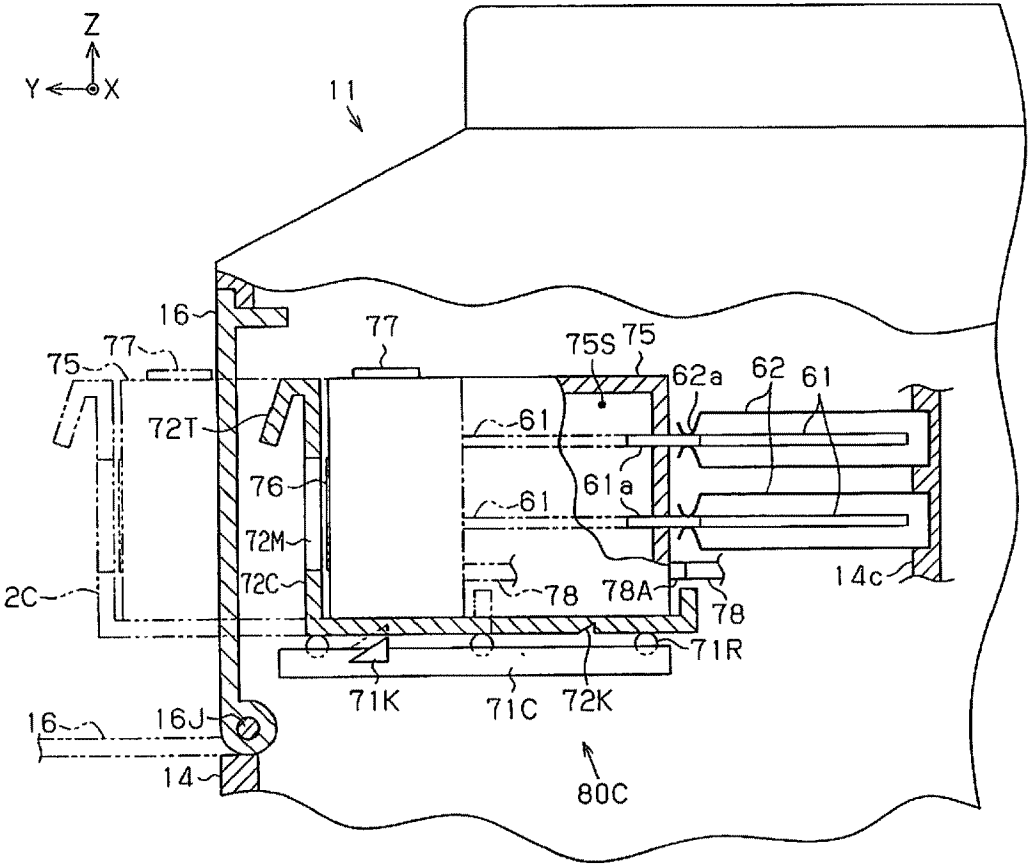
FIG. 7 is a side view schematically illustrating a configuration of a movement mechanism of an ink tank, the movement mechanism moving an injection port to the outside of an apparatus case by linear movement.

As illustrated in FIG. 7, a movement mechanism 80C of the present working example has: a tank holder 72C for holding the ink tanks 75 in at least the front-rear direction thereof, the tank holder being substantially L-shaped as seen from the width direction X; and a holder support stand 71C to which a plurality of rollers 71R are provided, on an upper surface. The tank holder 72C is placed atop the holder support stand 71C with the rollers interposed therebetween, thus enabling the user to easily move the tank holder back and forth along the holder support stand 71 by grasping a handle 72T provided to the front of the tank holder 72C and easily. A substantially triangular engagement groove 72K is provided to a lower surface of the tank holder 72C; the entry of a substantially triangular engagement claw 71K, disposed so as to project displaceably from the upper surface of the holder support stand 71C, into the engagement groove 72K regulates the amount of movement whereby the tank holder 72C is drawn forward, while also permitting backward movement thereof.

Also provided to the front of the tank holder 72C is a window hole 72M through which the labels 76 pasted onto the ink tanks 75 can be viewed, thus adopting such a configuration that the user is able to check the ink tanks 75 being drawn out. As such, in the present working example, there may be adopted such a configuration that the tank holder 72C is formed segmented into four along the width direction X of the sheet of paper P, whereby the user is able to separately check and draw out each of the ink tanks 75C, 75M, 75Y, 75K.

Thus, the movement mechanism 80C of the present working example enables movement of the tank holder 72C back and forth, by a manual operation by the user, in the unclosed state where the front cover 16 opens on the opening part. Also, as illustrated by the solid lines and the double-dashed lines in FIG. 7, the movement of the tank holder 72C from back to front as far as a position at which the amount of forward movement is regulated causes the first portion comprising the injection ports 77 in the ink tanks 75 to be displaced from the inside of the apparatus case 14 to the outside of the apparatus case 14, via the opening part. The movement mechanism 80C of the present working example is thus configured.

However, in some cases with the printer 11, an electrical signal may be transmitted between the apparatus case 14 (more specifically, the board unit 25) and the ink tanks 75, in order to detect the amount of ink remaining inside the ink tanks 75. In such a case, in the present working example, provided to the ink tank 75 side are two electrically conductive members 61, end parts 61*a* thereof being inserted into the inside of an ink chamber 75S, which is one example of a liquid containing portion. Meanwhile, two electrically conductive terminals 62 which are electrically connected to the board unit 25 and are formed so as to have opposing electrically conductive units 62*a* having a curved shape are fixed in a cantilever state to a case member 14*c*, which serves as the apparatus case 14 side, so that the electrically conductive unit 62*a* side is deflected.

The electrically conductive terminals 62 sandwich the electrically conductive members 61 from two sides due to the opposing electrically conductive units 62*a*, while the electrically conductive members 61 are in turn disposed extending in the front-rear direction at a length whereby the state of being sandwiched by the electrically conductive units 62*a* is maintained even when the electrically conductive members move in the front-rear direction together with the ink tanks 75. More specifically, as illustrated by the solid lines and the double-dashed lines in FIG. 7, adopted is such a configuration that electrical conduction between the electrically conductive members 61 and the electrically conductive terminals 62 is maintained at all times, even when the ink tanks 75 are moved forward so as to displace the first portion comprising the injection ports 77 from the inside of the apparatus case 14 to the outside of the apparatus case 14 via the opening part. As such, the electrically conductive members 61 and the electrically conductive terminals 62 function as an electrical connection unit enabling an electrical connection between the ink tanks 75 and the apparatus case 14 side.

In the present working example, the configuration may also be such that the electrically conductive terminals 62 are provided to the ink tank 75 side and the electrically conductive members 61 are provided to the case member 14*c* side. It shall be readily understood that in this case, the end parts 61*a* that are electrically connected to the electrically conductive terminals 62 are provided inserted inside of the ink chamber 75S, which is one example of the liquid containing portion.

Fourth Working Example of the Movement Mechanism

Figure 8:
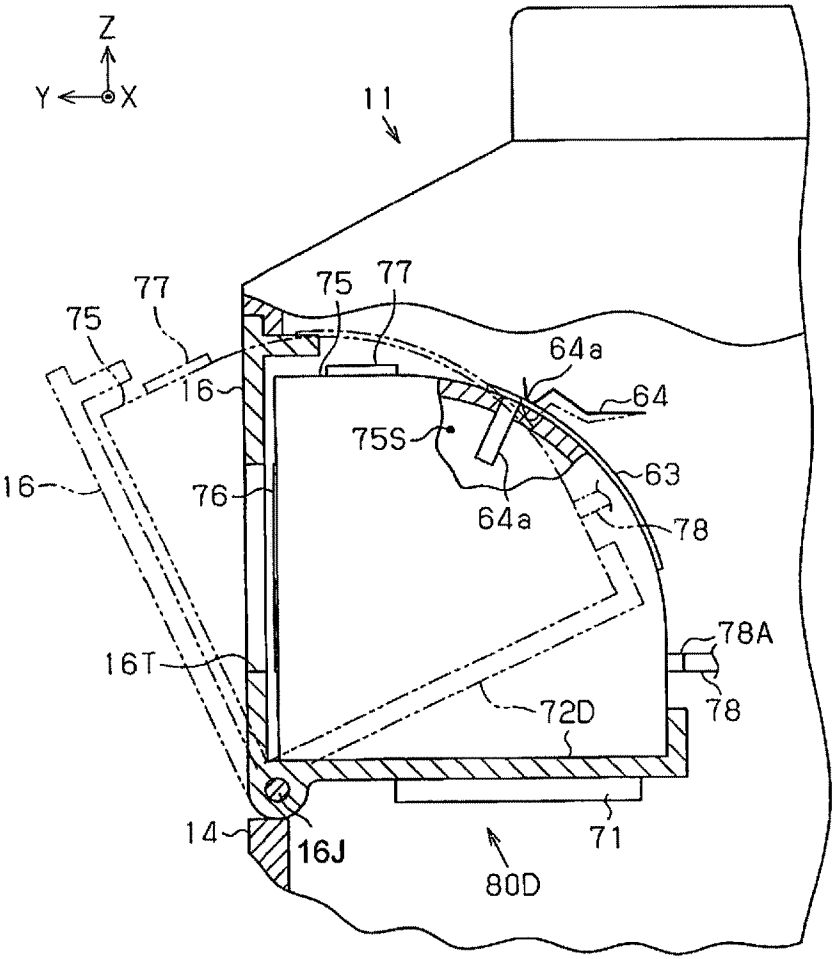
FIG. 8 is a side view schematically illustrating a configuration of a movement mechanism of an ink tank, the movement mechanism moving in rotation in conjunction with a front cover.

As illustrated in FIG. 8, a movement mechanism 80D of the present working example has: a tank holder 72D which rotates integrally with the front cover 16 about the rotating shaft 16J of the front cover 16, for example, by being formed integrally with the front cover 16, or the like; and the ink tanks 75, one part of which is formed in an arcuate shape. The shape of the ink tanks 75 is formed in a shape (herein, a substantially fan-like shape) that enables forward movement from the opening covered by the front cover 16, when the ink tanks are rotated about the rotating shaft 16J.

In the movement mechanism 80D of the present working example, in association with being moved by a manual operation by the user to the uncovered state where the front cover 16 opens on the opening part, the ink tanks 75 held by the tank holder 72D rotate about the rotating shaft 16J from behind toward the front, as illustrated by the solid lines and the double-dashed lines in FIG. 8. When the front cover 16 is rotated by a predetermined angle toward the uncovered state, the first portion comprising the injection ports 77 in the ink tanks 75 is displaced from the inside of the apparatus case 14 to the outside of the apparatus case 14, via the opening part. Though a more specific description of the configuration is omitted in the present working example, the tank holder 72D is positioned by a rotational degree determining unit (not shown) in the state where the injection ports 77 are moved to the outside of the apparatus case 14. The movement mechanism 80D of the present working example is thus configured.

In the present working example, for example, as illustrated in FIG. 8, an electrically conductive plate 63 and an electrically conductive terminal 64 are provided in a case where an electrical signal is to be transmitted between the apparatus case 14 (the board unit 25) and the ink tanks 75), such as for detecting the amount of ink remaining inside the ink tanks 75. More specifically, the electrically conductive plate 63 at which an end part 61*a* thereof is inserted into the ink chamber 75S, which is one example of a liquid containing portion, is provided to the ink tank 75 side in a state of being fixed along an arcuate shape. In turn, inside of the apparatus case 14, the electrically conductive terminal 64 which is electrically connected to the board unit 25 and at which an electrically conductive unit 64*a* having a curved shape is formed is fixed in a cantilevered state so that the electrically conductive unit 64*a* side is deflected.

The electrically conductive terminal 64 is contacted against the electrically conductive plate 63 by the electrically conductive unit 64*a*, while in turn the electrically conductive plate 63 is disposed extending along the arcuate shape at a length whereby the state of being contacted against the electrically conductive unit 64*a* is maintained, even when the electrically conductive plate rotates in the front-rear direction together with the ink tanks 75. More specifically, adopted is such a configuration that the electrical conduction between the electrically conductive plate 63 and the electrically conductive terminal 64 is maintained at all times, even when the ink tanks 75 are moved forward so as to displace the first portion comprising the injection ports 77 from the inside of the apparatus case 14 to the outside of the apparatus case 14, via the opening part. As such, the electrically conductive plate 63 and the electrically conductive terminal 64 function as an electrical connection unit for enabling an electrical connection between the ink tanks 75 and the apparatus case 14 side. FIG. 8 depicts only one each of the electrically conductive plate 63 and the electrically conductive terminal 64, but a plurality thereof may also be provided in a state, for example, of being arranged side by side along the width direction X.

In the present working example, tubes that are elastically deformable are employed for the connecting tubes 78 connected to the ink tanks 75, there being thus no impediment even when the curved parts 78W (see FIG. 6) that curve at least in part in the natural state are formed.

Fifth Working Example of the Movement Mechanism

Figure 9:
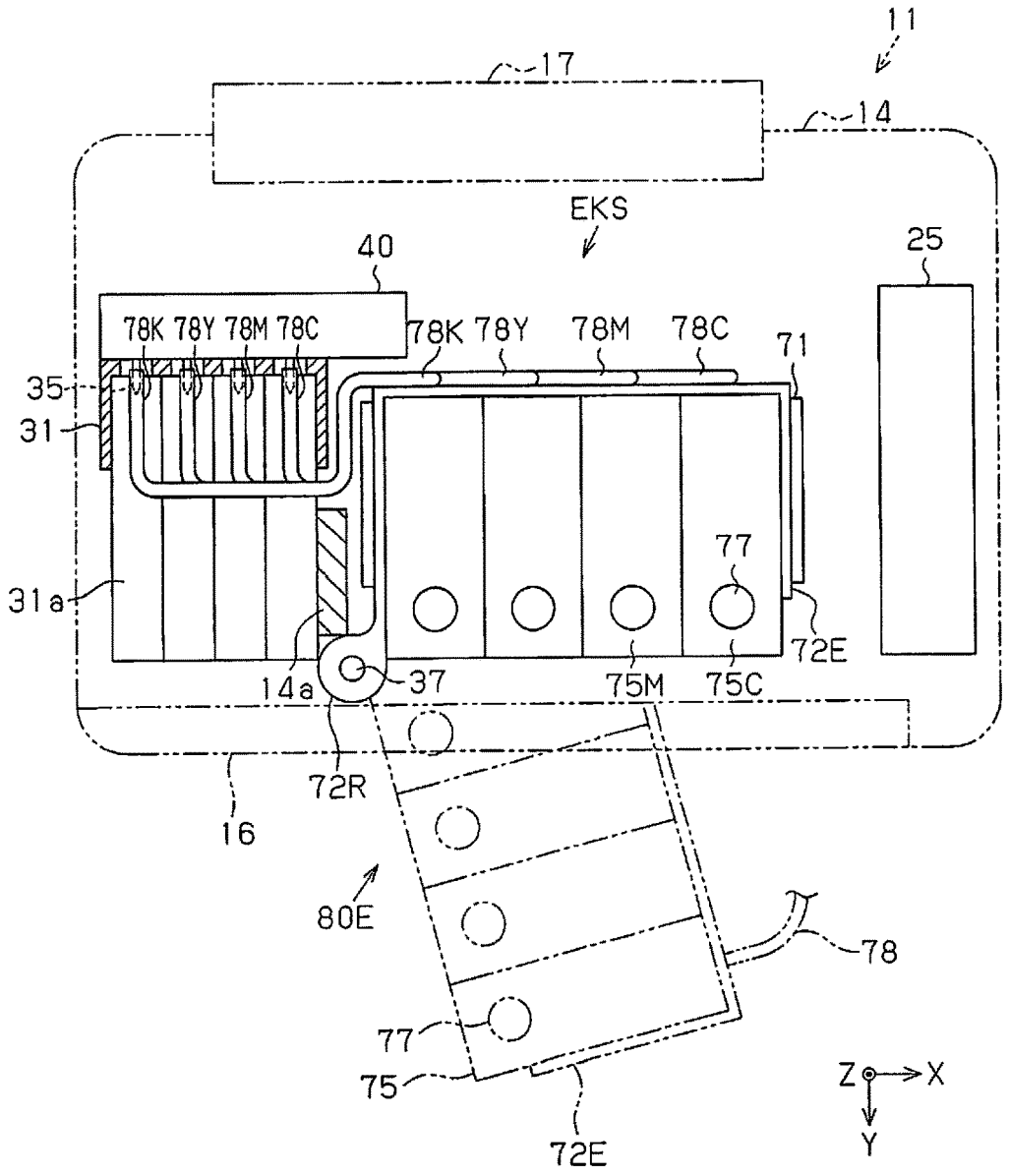
FIG. 9 is a plan view schematically illustrating a configuration of a movement mechanism of an ink tank, the movement mechanism moving an injection port to the outside of an apparatus case by rotational movement in which the axial direction of a rotating shaft is the vertical direction.

As illustrated in FIG. 9, a movement mechanism 80E of the present working example has a tank holder 72E on which is formed a rotating part 72R for rotating about a rotating shaft 37 having an axis in the vertical direction, provided to the case wall part 14*a*. The holder support stand 71 is provided in a state that will not hinder rotation of the tank holder 72E about the rotating shaft 37.

In the movement mechanism 80E of the present working example, in a state where the front cover 16 is placed by the manual operation by the user in the uncovered state opening on the opening part, the ink tanks 75 held by the tank holder 72E rotate toward the front from the rear about the rotating shaft 37, as illustrated by the solid lines and the double-dashed lines in FIG. 9. The first portion, comprising the injection ports 77, in the ink tanks 75 is thereby displaced from the inside of the apparatus case 14 to the outside of the apparatus case 14, via the opening part. In the present working example, the opening part covered by the front cover 16 is formed to be of a size permitting rotation of the ink tanks 75 so that the injection ports 77 are positioned on the outside of the apparatus case 14. The movement mechanism 80E of the present working example is thus configured.

Described next are the actions of the printer 11 provided with the movement mechanism (80A to 80E) for the ink tanks 75.

Upon, for example, seeing via the see-through region 16T of the front cover 16 in the closed state that there is little remaining of the ink contained in the ink tanks 75 due to the consumption of the ink, the user operates the movement mechanism. More specifically, either the front cover 16 is rotated, or the front cover 16 is rotated and thereafter the tank holder 72 is moved, whereby the ink tanks 75 are moved from the back to the front. This causes the ink tanks 75 to issue forth forward from the opening part, which is released due to the rotation of the front cover 16, and causes the first portion comprising the injection ports 77 of the ink tanks 75 to be positioned on the outside of the apparatus case 14 of the printer 11 in a state where, for example, the injection ports 77 are visible via the opening part. Herein, the "state where . . . the injection ports 77 are visible" refers to a state where the injection of ink from the injection ports 77 is possible.

In the first embodiment described above, at least a part of the ink tanks 75 should be contained within the first spatial part SP3; in addition to a mode where all of the ink tanks 75 is contained within the second spatial part SP3, further comprised is a mode where only a part of the ink tanks 75 is contained within the second spatial part SP3. For example, as a modification example of the third working example, there may also be a mode where the substantially triangular engagement groove 72K is provided to the lower surface of the ink tanks 75 and a part of the ink tanks 75 engages with the engagement claw 71K. There may also be a mode where the other part thereof is positioned on the outside of the second spatial part SP3. Also, for example, as a modification example of the fourth working example, there may be a mode where a rotating part rotated by the rotating shaft 16J is provided to the lower surface of the ink tanks 75. There may also be a mode where portions of the ink tanks 75 other than the rotating part are positioned are on the outside of the second spatial part SP3. Also, for example, as a modification example of the fifth working example, there may be a mode where the rotating part 72R is provided to a part of the ink tanks 75. There may also be a mode where portions of the ink tanks 75 other than the rotating part 72R are positioned are on the outside of the second spatial part SP3. According to the first embodiment described above, it is possible to yield effects as follows.

(1) In the printer 11, it is easy to cause the ink to flow into the ink chamber 75S from the injection ports 77, because when the front cover 16 is placed in the uncovered state, the first portion of the ink tanks 75 can be moved so that, for example, the injection ports 77 are displaced to a position at which the task of injecting ink is easy. Further, placing the front cover 16 in the closed-off state curbs the accumulation of dust onto the ink tanks 75.

(2) In the printer 11, it is possible to quickly displace the injection ports 77 to a position at which the task of injecting the ink is easy, simultaneously with, for example, the front cover 16 entering the uncovered state, because the first portion comprising at least the injection ports 77 is displaced in conjunction with the movement of the front cover 16.

(3) In the printer 11, it is possible to displace the injection ports 77 to a position at which the task of injecting the ink is easy, by the shortest distance of movement, because the ink tanks 75 are moved linearly.

(4) In the printer 11, it becomes possible to displace the injection ports 77 to a position at which the task of injecting the ink is easy, by a rotating movement that can be achieved by relatively simple structure.

(5) In the printer 11, deterioration of the connecting tubes 78 is curbed and the ink can be supplied from the ink tanks 75 in a stable manner, because of suppression so as to prevent bending stress from being applied to the connecting tubes 78 in the state where the connecting tubes are connected to the supply ports 78A, provided on one side of the ink tanks 75, due to the connecting tubes 78 on which are formed the curved parts 78W which curve in the natural state.

(6) An electrical signal relating to, for example, the ink being injected can be transmitted to the printer 11 side at the time of the task of injecting the ink from the injection ports 77, because the first portion comprising the injection ports 77 can be displaced to the outside of the apparatus case 14 in a state where the ink tanks 75 and the apparatus case 14 are electrically connected to each other.

Second Embodiment

The liquid container unit of the second embodiment shall be described next. In the description of the second embodiment, those constituent elements which are identical to those of the printer 11 in the first embodiment have been assigned identical reference numerals, and a description thereof shall be omitted as appropriate.

Figure 10:
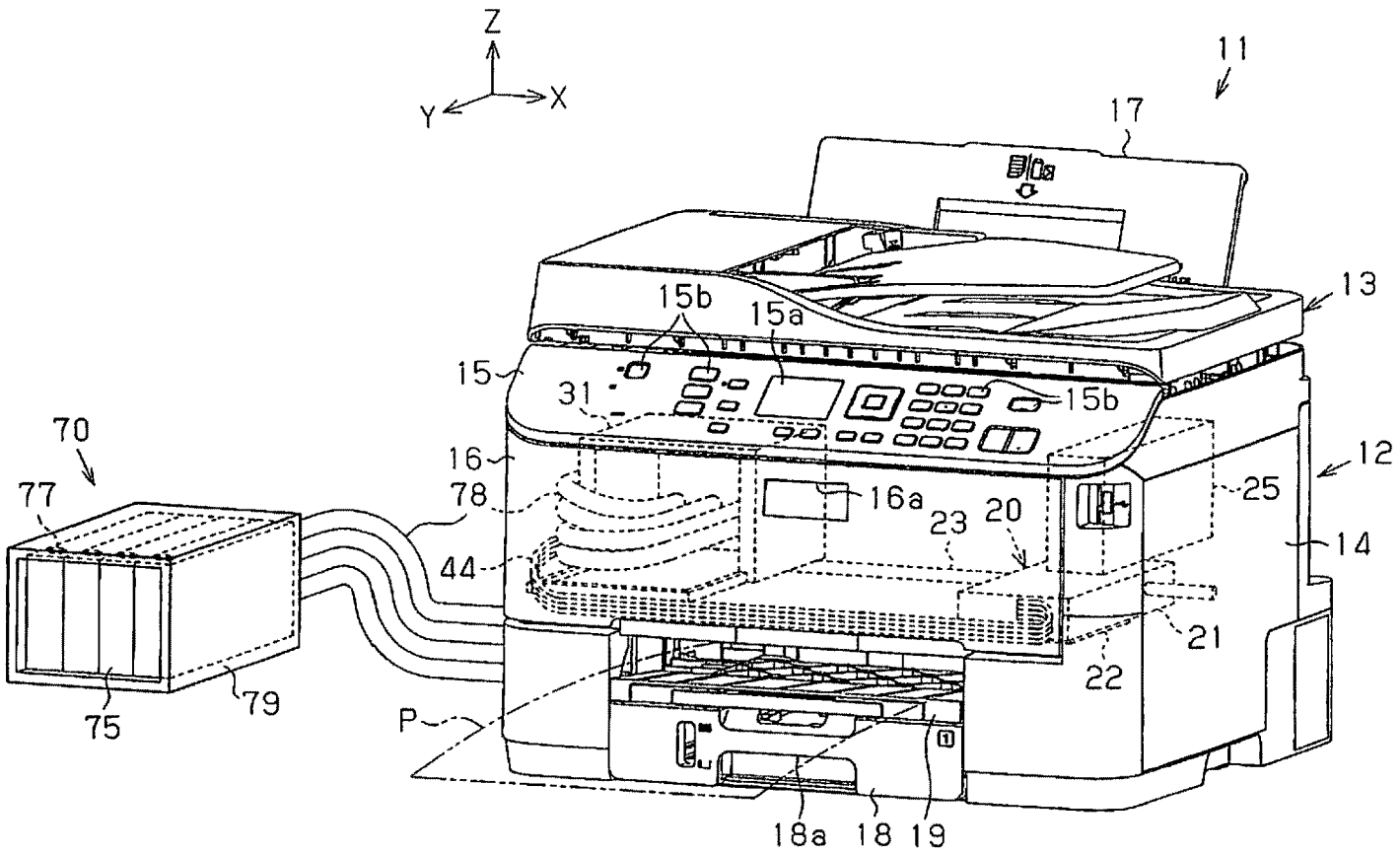
FIG. 10 is a perspective view illustrating an embodiment of a tank unit.

As illustrated in FIG. 10, a tank unit 70, which is one example of the liquid container unit, is provided with the ink tanks 75 having the injection ports 77 for ink, which are one example of the liquid containers, as well as with a tank case 79, which is one example of a container holder, for holding the ink tanks 75. The tank case 79 has a substantially boxed shape, which opens in one direction; insertion of the ink tanks 75 from the opening thereof makes it possible to hold the ink tanks 75 in the interior in a state where the injection ports 77 are not exposed. The tank unit 70 supplies the ink to the printer 11 from the ink tanks 75 via the connecting tubes 78, which are connected to the supply ports 78A of the ink tanks 75 being held inside the tank case 79.

In the tank unit 70 of the present embodiment, the tank case 79 has a structure for holding the ink tanks 75 in a state where the first portion comprising at least the injection ports 77 in the ink tanks 75 can be displaced in a relative manner with respect to the tank case 79. Working examples (a first through third working example) of this holding structure shall be described with reference to FIGS. 11 to 15. FIGS. 11 to 15 depict the tank unit 70 as being in a state where the opening of the tank case 79 is oriented in the discharge direction Y, for the sake of convenience of description.

In the present detailed description, the statement "displaced in a relative manner" may signify that a difference in the absolute displacement between two points of the structure occurs. For example, in the second embodiment, it may be that only the first portion of the ink tanks 75 moves, and the tank case 79 does not move, or it may be that the first portion of the ink tanks 75 does not move and only the tank case 79 moves, or it may be that both the first portion of the ink tanks 75 and the tank case 79 move. The same is also true of the third embodiment.

First Working Example of the Holding Structure

Figure 11:
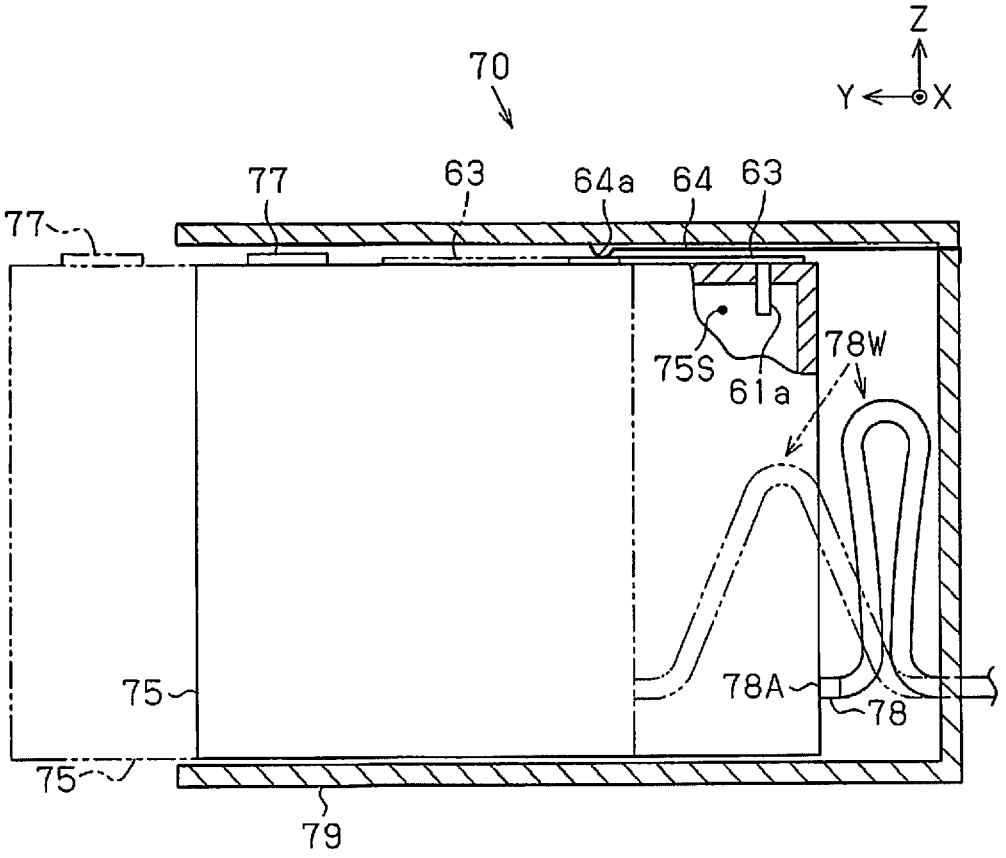
FIG. 11 is a side view schematically illustrating a configuration of a tank unit.

As illustrated by the solid lines and the double-dashed lines in FIG. 11, the holding structure of the present working example holds the ink tanks 75 so as to enable linear movement, along the discharge direction Y, which is the opening side of the tank case 79, so that the injection ports 77 move a minimum distance, from the interior of the tank case 79 (from the inside of the tank case 79) to the exterior of the tank case 79 (to the outside of the tank case 79).

Figure 12B:
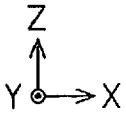
FIGS. 12A and 12B are front views schematically illustrating a guide rail structure for linearly moving an ink tank.
Figure 12B:
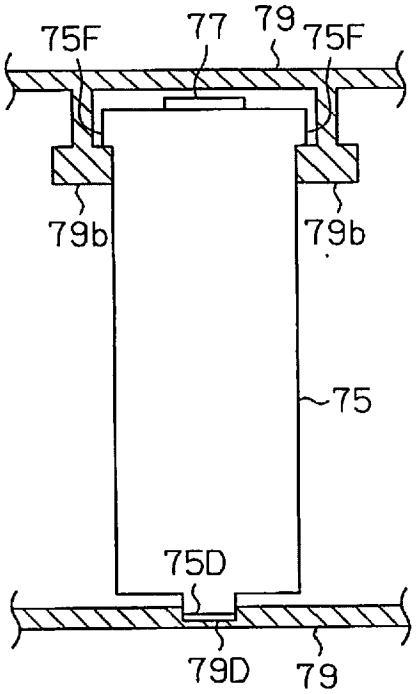
Figure 12A:
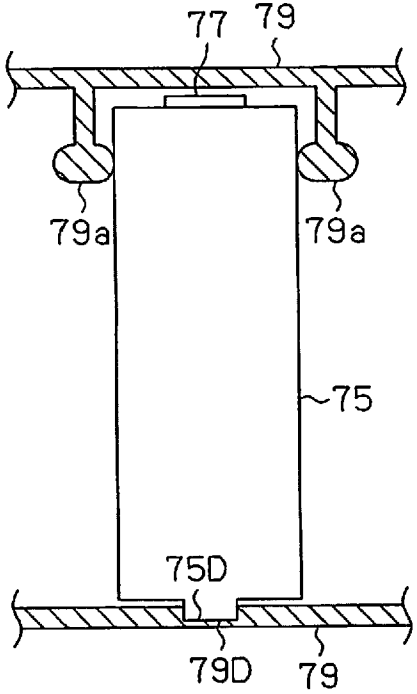

More specifically, as illustrated in FIG. 12A, a protruding part 75D is provided along the discharge direction Y on the lower surface of the ink tanks 75, and a groove part 79D is provided along the discharge direction Y on an inner bottom surface positioned on the lower side of the tank case 79. The ink tanks 75 are configured so that the protruding part 75D thereof slides in the groove part 79D, which functions as a guide rail, whereby the lower end side can be positioned in the width direction X and also moved linearly along the discharge direction Y. A guide rib 79*a* is provided along the discharge direction Y to an inner ceiling positioned on the upper side of the tank case 79; the guide rib 79*a* prevents the upper end side of the ink tanks 75, which moves along the discharge direction Y, from tilting in the width direction X.

Alternatively, as illustrated in FIG. 12B, an eaves-shaped part 75F projecting on both sides of the width direction X is provided at the upper end part of the ink tanks 75, and a guide rib 79*b* is provided along the discharge direction Y on the inner ceiling positioned on the upper side of the tank case 79. The distal end part of the guide rib 79*b* is adapted to abut from below against the eaves-shaped part 75F, which functions as a guide rail, whereby the ink tanks 75 can be positioned in the width direction X and also linearly moved along the discharge direction Y, while also being in sliding contact with the guide rib 79*b*. A protruding part 75D is provided along the discharge direction Y on the lower surface of the ink tanks 75, and a groove part 79D is provided along the discharge direction Y on an inner bottom surface positioned on the lower side of the tank case 79. The lower end side of the ink tanks 75 is prevented from tilting in the width direction X due to the positioning of the protruding part 75D inside of the groove part 79D.

As illustrated in FIG. 11, in the tank unit 70 of the present working example, the electrically conductive plate 63 and the electrically conductive terminal 64, which function as the electrical connection unit, are provided between the tank case 79 and the ink tanks 75 in a case where an electrical signal is to be transmitted between the printer 11 side and the ink tanks 75, such as, for example, for detecting the amount of ink remaining inside the ink tanks 75. More specifically, the electrically conductive plate 63, electrically connected to the end part 61*a* inserted into the ink chamber 75S, is provided to the ink tanks 75 in a state of being fixed to the upper surface thereof with the discharge direction Y serving as the lengthwise direction. In turn, the electrically conductive terminal 64 on which is formed the electrically conductive unit 64*a* for making contact with the electrically conductive 63 is fixed to the tank case 79 on the inner ceiling thereof in a cantilevered state so that the electrically conductive unit 64*a* side is deflected. As illustrated by the solid lines and the double-dashed lines in FIG. 11, adopted is such a configuration that the electrical conduction between the electrically conductive plate 63 and the electrically conductive terminal 64 is maintained at all times, even when the ink tanks 75 are moved forward, so that the first portion comprising the injection ports 77 is displaced to the outside of the tank case 79.

In the tank unit 70 of the present working example, tubes that are elastically deformable are employed for the connecting tubes 78 connected to the ink tanks 75, forming at least in part the curved part 78W that is curved in the natural state. As such, as illustrated by the solid lines and the double-dashed lines in FIG. 11, the connecting tubes 78 are enabled to be displaced in a state where little stress is generated in association with the movement of the ink tanks 75 from the inside of the tank case 79 to the outside along the discharge direction Y.

In the holding structure of the present working example, the tank case 79 may hold the ink tanks 75 in a state in which the first portion comprising at least the injection ports 77 can be displaced in a relative manner with respect to the tank case 79, after movement of the ink tanks 75 in the direction opposite to the direction of movement when the injection ports 77 are being moved from the inside of the tank case 79 to the outside of the tank case 79 (the discharge direction Y).

Figure 13A:
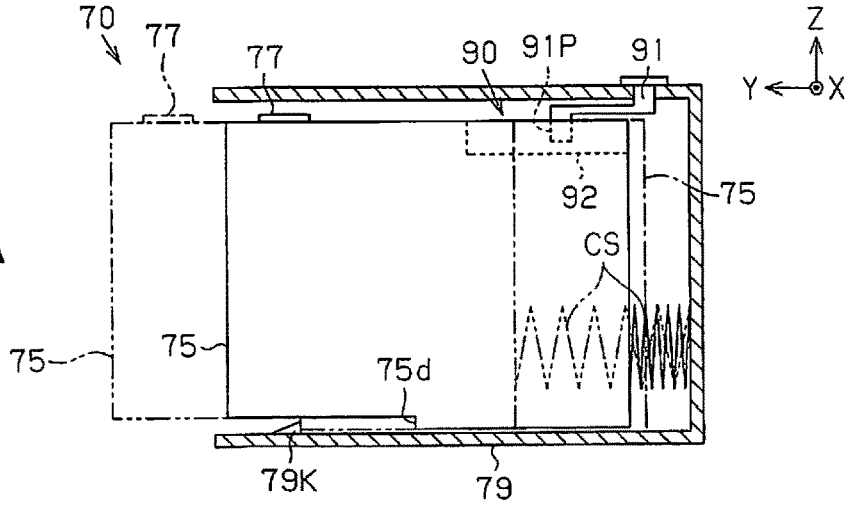
FIGS. 13A-13C are drawings schematically illustrating a configuration of a tank unit provided with a positioning mechanism for an ink tank, where

More specifically, as illustrated in FIG. 13A, the ink tanks 75 inside of the tank case 79 are urged in the discharge direction Y by an urging member CS, such as a coil spring, while in turn also being provided with a positioning mechanism 90 for positioning by resisting against this urging and suppressing movement of the ink tanks 75 in the discharge direction Y. The positioning mechanism 90 is constituted of an engagement member 91 one end of which is rotatably supported by the tank case 79 and at the other end of which a cylinder pin 91P is formed, and an engaged part 92 to which a predetermined concavo-convex shape is provided.

Figure 13B:
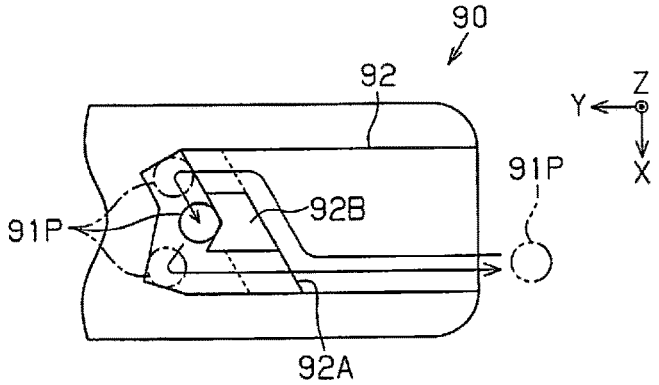

As illustrated in FIG. 13B, the engaged part 92 is formed to have a concavo-convex shape constituting a movement route that allows the cylinder pin 91P in the engagement member 91 to move repeatedly. In fact, movement of the ink tanks 75 causes the cylinder pin 91P to move in a relative manner with respect to the ink tanks 75 along the movement route thus formed, as is illustrated by the solid-line arrows in FIG. 13B.

For example, as illustrated by the solid lines in FIG. 13B, the cylinder pin 91P enters a state of abutting against a discharge direction Y side end surface of a convexly shaped part 92B in the engaged part 92, whereby the ink tanks 75 are placed in a state of being contained so that the injection ports 77 are not exposed, i.e., in an ordinary usage state where the injection ports 77 are positioned on the inside of the tank case 79. From this state, the ink tanks 75 enter a state of being pushed into the position illustrated by the single-dashed line in FIG. 13A when there is performed a push operation in which the ink tanks 75 are pushed in the direction opposite to the discharge direction Y, i.e., in the direction opposite to the urging direction of the urging member CS. As a result, the engagement with the convexly shaped part 92B is released by movement of the cylinder pin 91P toward the discharge direction Y side along the movement route, and the ink tanks 75 are thus urged by the urging member CS and moved forward. In other words, the cylinder pin 91P moves rearward in a relative manner, as illustrated by the double-dashed lines in FIG. 13A.

Forward movement of the ink tanks 75 is restricted by abutting of the engagement claw 79K, which is formed so as to project out on the inner bottom surface of the tank case 79, against a stepped part 75*d* provided to the lower surface of the ink tanks 75. When at the position at which forward movement is restricted, the ink tanks 75 adopt a state where the injection ports 77 are exposed to the outside of the tank case 79. The cylinder pin 91P moves to the position illustrated by the double-dashed line in FIG. 13B. It will be readily understood that when the ink tanks 75, being in a state where the injection ports 77 are exposed, are pushed in the direction opposite to the discharge direction Y, the cylinder pin 91P is positioned at the position of the ordinary usage state illustrated in FIG. 13B by the solid lines, by moving along a sloped part 92A as illustrated by the solid-line arrow from the positioned illustrated by the double-dashed lines in FIG. 13B.

Figure 13C:
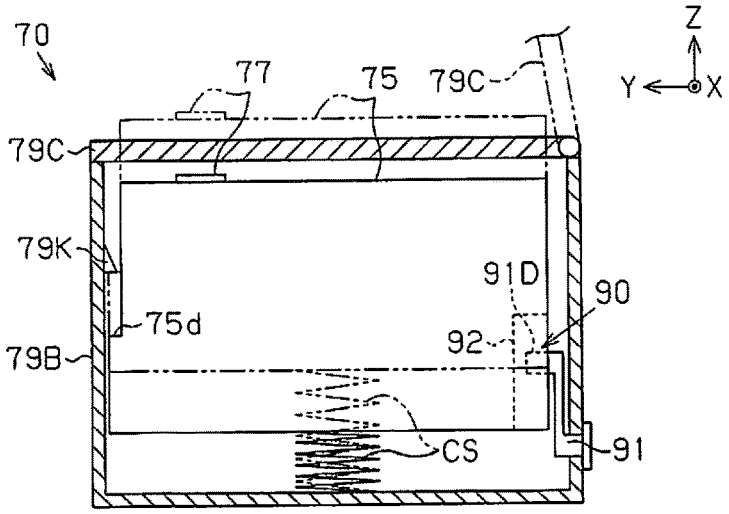

As illustrated in FIG. 13C, the holding structure of the present working example is not restricted to a case where the ink tanks 75 move linearly along the discharge direction Y in the tank unit 70, but rather can also be employed in a case where the ink tanks 75 move linearly along the up-down direction, which is the vertical direction.

More specifically, the tank unit 70 contains the ink tanks 75, which move linearly in the up-down direction, on the inside of a tank case 79B, which is in the shape of a bottomed box, upper side in the vertical direction Z of which is opened. When the ink tanks 75 are pushed in the downward direction, then the engagement of the engagement member 91 having been released in the positioning mechanism 90, the ink tanks 75 are elevated by the urging member CS to a position illustrated by the double-dashed line from the positioned illustrated by the solid line in FIG. 13B. The elevation of the ink tanks 75 causes the injection ports 77 to move to the outside of the tank case 79B.

In the case of the configuration where the ink tank moves up and down, in this manner, there is preferably provided a case cover 79C for covering the opening of the tank case 79B so that the injection ports 77 are not exposed in the ordinary usage state. It will be readily understood that the case cover 79C opens the opening of the tank case 79B, by sliding movement or the like, when ink is to be injected from the injection ports 77.

Second Working Example of the Holding Structure

As illustrated in FIGS. 13A-13C, the holding structure of the present working example holds the ink tanks 75 within the tank case 79 so as to enable rotating movement, i.e. sliding movement, with the width direction X serving as the axis, about a rotating shaft 75J pivotally supported so as to be able to rotate at an opening end part of the inner bottom surface of the tank case 79. The ink tanks 75 are formed in part in, for example, an arcuate shape, and are shaped (herein, an eaves-shaped shape) so as to be moveable so as not to interfere with the tank case 79 when rotated about the rotating shaft 75J.

Figure 14:
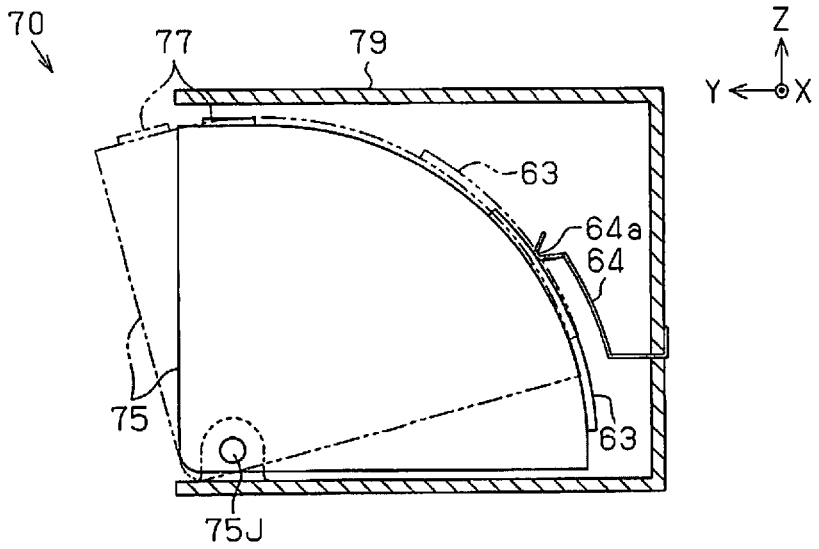
FIG. 14 is a side view schematically illustrating a configuration of a movement mechanism of an ink tank, the movement mechanism moving in rotation within a tank unit.

In the holding structure of the present working example, in association with the ink tanks 75 being drawn out from the tank case by a manual operation by the user, the ink tanks 75 rotate from the rear toward the discharge direction Y, which is forward, about the rotating shaft 75J, as illustrated by the solid line and the double-dashed line in FIG. 14. As a result, the first portion comprising the injection ports 77 in the ink tanks 75 is displaced to the outside of the tank case 79. In the present working example, although a description of the specific configuration is omitted, the ink tanks 75 are positioned by a rotational degree determining part (not shown) in the state where the injection ports 77 are moved to the outside of the tank case 79.

In the present working example, the electrically conductive plate 63 and the electrically conductive terminal 64, which function as the electrical connection unit, are provided between the tank case 79 and the ink tanks 75 in a case where an electrical signal is to be transmitted between the printer 11 side and the ink tanks 75, such as, for example, for detecting the amount of ink remaining inside the ink tanks 75. More specifically, the electrically conductive plate 63 is provided to the ink tank 75 side in a state of being fixed along an arcuate shape. In turn, the electrically conductive terminal 64, on which the electrically conductive unit 64*a* having a curved shape is formed, is fixed to the tank case 79 side in a cantilevered state so that the electrically conductive part 64*a* is deflected. Adopted is such a configuration that the electrical conduction between the electrically conductive plate 63 and the electrically conductive terminal 64 is maintained at all times, even when the ink tanks 75 are rotatingly moved forward so that the first portion comprising the injection ports 77 is displaced to the outside of the tank case 79, as illustrated by the solid lines and the double-dashed lines in FIG. 14.

In the tank unit 70 having the holding structure of the present working example, too, although a depiction has been omitted in FIG. 14, the connecting tubes 78 in which is formed the curved part 78W that is curved in the natural state can be in communication with the ink tanks 75 via the supply ports 78A provided to the ink tanks 75. It would also be possible for the positioning mechanism 90 to also be provided, as needed.

Third Working Example of the Holding Structure

Figure 15:
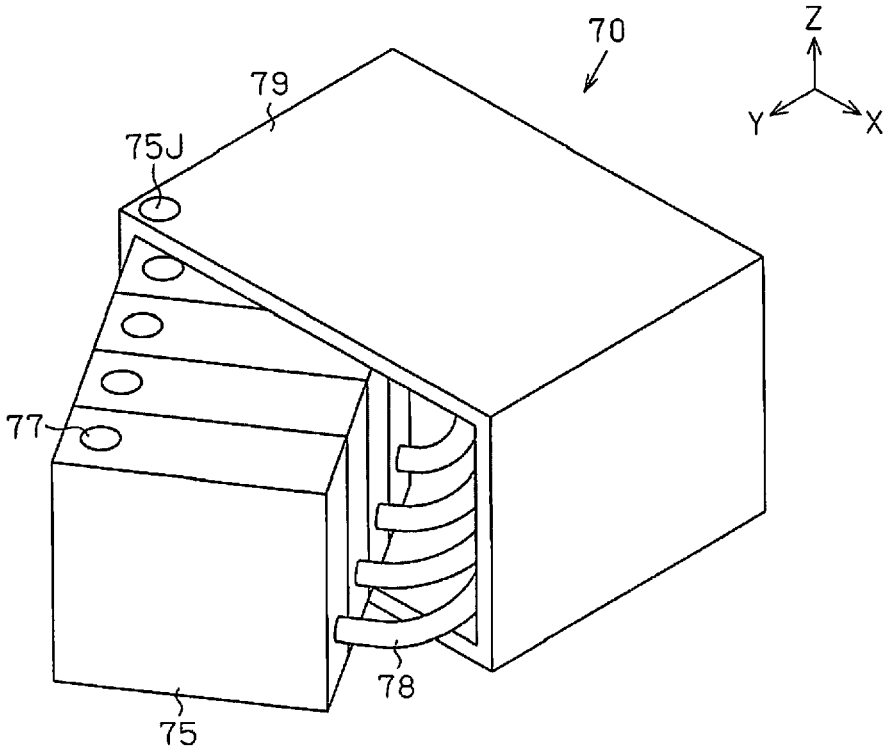
FIG. 15 is a plan view schematically illustrating a configuration of a movement mechanism of an ink tank, the movement mechanism moving an injection port to the outside of a tank unit by a rotational movement in which the axial direction of a rotating shaft is the vertical direction.

As illustrated in FIG. 15, the holding structure of the present working example holds the ink tanks 75 within the tank case 79 so as to enable horizontally directed rotating movement, i.e. sliding movement, with the vertical direction serving as the axis, about a rotating shaft 75J pivotally supported so as to be able to rotate at one opening end part of the tank case 79 in the width direction X. As such, the tank case 79 is formed to have a length whereby the sliding ink tanks 75 do not interfere with the tank case 79, in the width direction X.

In the holding structure of the present working example, in association with the ink tanks 75 being drawn out from the tank case by a manual operation by the user, the ink tanks 75 rotate from the rear toward the discharge direction Y, which is forward, about the rotating shaft 75J, as illustrated in FIG. 15. As a result, the first portion comprising the injection ports 77 in the ink tanks 75 is displaced to the outside of the tank case 79. In the present working example, although a description of the specific configuration is omitted, the ink tanks 75 are positioned by a rotational degree determining part (not shown) in the state where the injection ports 77 are moved to the outside of the tank case 79.

In the tank unit 70 having the holding structure of the present working example, too, although a depiction has been omitted in FIG. 15, the curved parts 78W that are curved in the natural state may also be formed on the connecting tubes 78 connected to the supply ports 78A of the ink tanks 75. The positioning mechanism 90 may also be provided, as needed.

Described next are the effects of the tank unit 70 of the present embodiment provided with the holding structure for the ink tanks 75. When looking through the upper surface 75*a* or lower surface 75*b* (see FIG. 3) of the labels 76, for example to check for whether there is little ink remaining inside the ink tanks 75 contained in the tank case 79 due to the consumption of the ink, the user moves the ink tanks 75. More specifically, the ink tanks 75 are moved forward from the rear by linear movement or rotating movement from the tank case 79. This causes the first portion comprising the injection ports 77 of the ink tanks 75 to issue forth to the outside of the tank case 79 and to be exposed in a state where, for example, viewing from above is possible. According to the second embodiment described above, it is possible to yield effects as follows.

(7) In the tank unit 70, it is easy to cause the ink to flow into the ink chamber 75S from the injection ports 77, because displacing the first portion comprising the injection ports 77 with respect to the tank case 79 makes it possible to displace the injection ports 77 to a position at which the task of injecting the ink is easy.

(8) In the tank unit 70, it is possible to displace the injection ports 77 to a position at which the task of injecting the ink is easy, at a minimum distance of movement of the ink tanks 75, because the ink tanks 75 move linearly.

(9) In the tank unit 70, the ink tanks 75 can be easily moved in a linearly manner along the guide rail.

(10) In the tank unit 70, moving the ink tanks 75 by a rotation that can be achieved by a relatively simple structure makes it possible to displace the injection ports 77 to a position at which the task of injecting the ink is easy.

(11) The injection ports 77 can be displaced to a position at which the task of injection the ink is easy, because the injection ports 77 enter a state of having moved from the interior of the tank case 79 to the exterior when the first portion comprising the injection ports 77 in the ink tanks 75 is displaced. Also, in the case of the ordinary use state where the task of injecting the ink is not being carried out, the ink tanks 77 are positioned in the interior of the tank case 79, whereby the accumulation of dust onto the injection ports 77 is curbed.

(12) In the tank unit 70, faulty displacement of the injection ports 77 is curbed, because, for example, pushing on the ink tanks 75 to move same in the direction inverse to the direction of displacement of the injection ports 77 allows the user to displace the injection ports 77 to a position at which the task of injecting the ink is easy.

(13) In the tank unit 70, deterioration of the tubes is curbed and the ink can be supplied from the ink tanks 75 in a stabilized manner, because of suppression so as to prevent bending stress from being applied to the connecting tubes 78 in the state where same are held by the ink tanks 75, due to the connecting tubes 78 on which are formed the curved parts 78W which curve in the natural state.

(14) An electrical signal relating to, for example, the ink being injected can be transmitted to the tank case 79 side (the printer 11 side) at the time of the task of injecting the ink from the injection ports 77, because the first portion comprising the injection ports 77 can be displaced to the outside of the tank case 79 in a state where the ink tanks 75 and the tank case 79 are electrically connected to each other.

Third Embodiment

The liquid container of the third embodiment shall be described next. In the description of the third embodiment, those constituent elements which are identical to those of the printer 11 in the first embodiment and the tank unit 70 of the second embodiment have been assigned identical reference numerals, and a description thereof shall be omitted as appropriate.

The present embodiment is the ink tanks 75, to which are provided: the injection port 77 for ink; the ink chamber 75S, which is a liquid containing portion, capable of containing the ink that is injected from the injection ports 77; and the supply port 78A, which can be connected to the liquid supply member capable of communication to the liquid ejection head of the printer 11, wherein the ink tanks have a displacement structure whereby the first portion comprising the injection ports 77 in the ink tanks 75 can be displaced in a relative manner with respect to a second portion which is different than the first portion and includes the ink chamber 75S, within the ink tanks 75. Working examples (a first through third working example) of this displacement structure shall now be described, with reference to FIGS. 16A-16B to 19A-19C. FIGS. 16A-16B to 19A-19C depict the ink tanks 75 as being in a state where the injection ports 77 are positioned on the discharge direction Y side, for the sake of convenience of description.

The "discharge direction Y" mentioned in the third embodiment refers to the direction in which the first portion comprising the injection ports 77 within the liquid container are displaced in order for the ink to be injected in a case where the liquid container described in the third embodiment is arranged in the interior of the printer 11 or the tank case 79. As such, the direction may be any direction, provided that the ink can be injected from the injection ports 77 when the first portion is displaced, and is not necessarily limited to being the discharge direction Y that is illustrated in the accompanying drawings.

First Working Example of the Displacement Structure

Figure 16A:
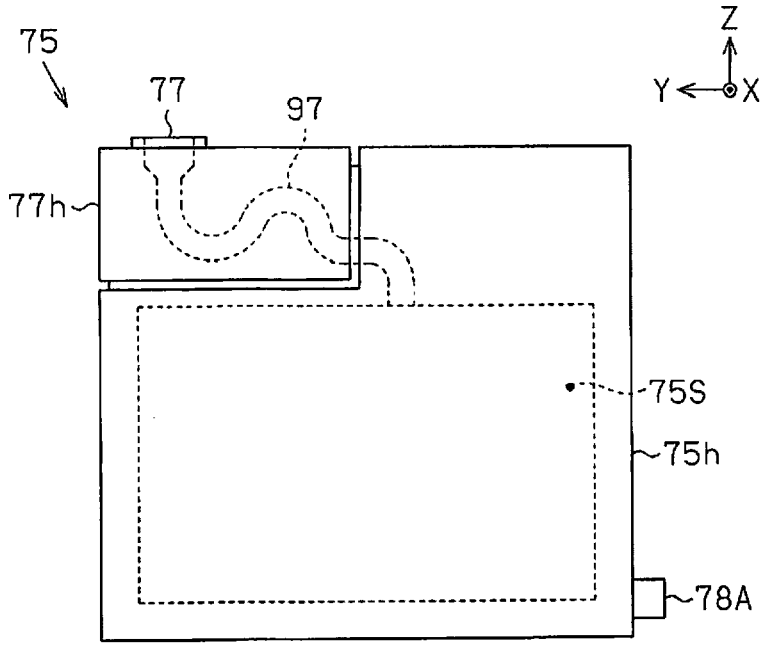
FIG. 16A is a side view illustrating an ink tank in which a first portion comprising an injection port is able to move in a relative manner with respect to a second portion which is different than the first portion and includes an ink chamber, within an ink tank.

As illustrated in FIG. 16A, as regards the displacement structure of the present working example, a displacement unit 77*h* serving as the first portion comprising the injection ports 77 is slideably attached in the ink tanks 75 along the discharge direction Y to a tank body part 75*h* serving as the second portion different than the first portion. A connection between the displacement unit 77*h* and the tank body part 75*h* is established by an interconnecting tube 97*h*, which is one example of a tube for making it possible for ink to flow from the injection ports 77 to the ink chamber 75S provided to the inside of the tank body part 75*h*.

Figure 16B:
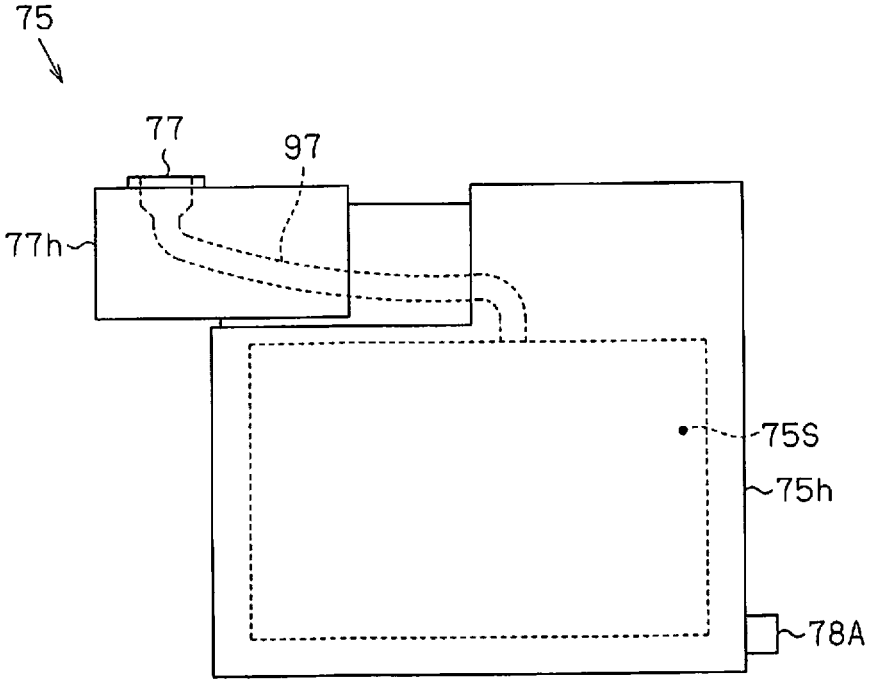
FIG. 16B is a side view illustrating an ink tank in a state where a first portion comprising an injection port is moved in a relative manner with respect to a second portion.

As such, as illustrated in FIG. 16B, the displacement structure of the present working example makes it possible for the displacement unit 77*h* to be displaced with the injection ports 77 moving linearly in the discharge direction Y, and also makes it possible for the ink to be injected in this displaced state into the ink chamber 75S from the injection ports 77 via the interconnecting tubes 97.

Figure 17A:
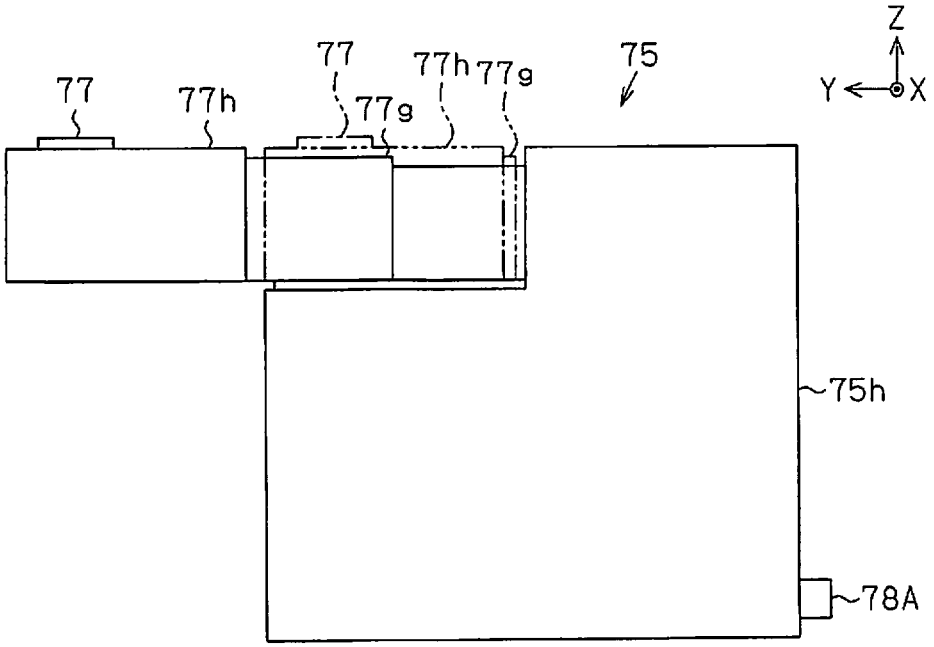
FIGS. 17A and 17B are drawings illustrating an ink tank in which a first portion comprising an injection port is constituted of a plurality of members, where

Alternatively, as illustrated in FIG. 17A, the displacement structure of the present working example may also be constituted of a plurality (herein, two) of displacement units 77*h*, 77*g* that are attached in the ink tanks 75 so that the first portion comprising the injection ports 77 can slide along the discharge direction Y with respect to the tank body part 75*h*, which is the second portion different than the first portion. Although FIG. 17A omits a depiction, the interconnecting tubes 97 for making it possible for the ink to flow form the injection ports 77 to the ink chamber 75S provided to the inside of the tank body part 75*h* are disposed between the displacement unit 77*h* and the tank body part 75*h*.

As such, as illustrated by the double-dashed lines and the solid lines in FIG. 17A, the displacement unit 77*h* and the displacement unit 77*g* can be linearly moved and displaced in the discharge direction Y and, in this displaced state, the injection ports 77 can be even further displaced toward the discharge direction Y.

Figure 17B:
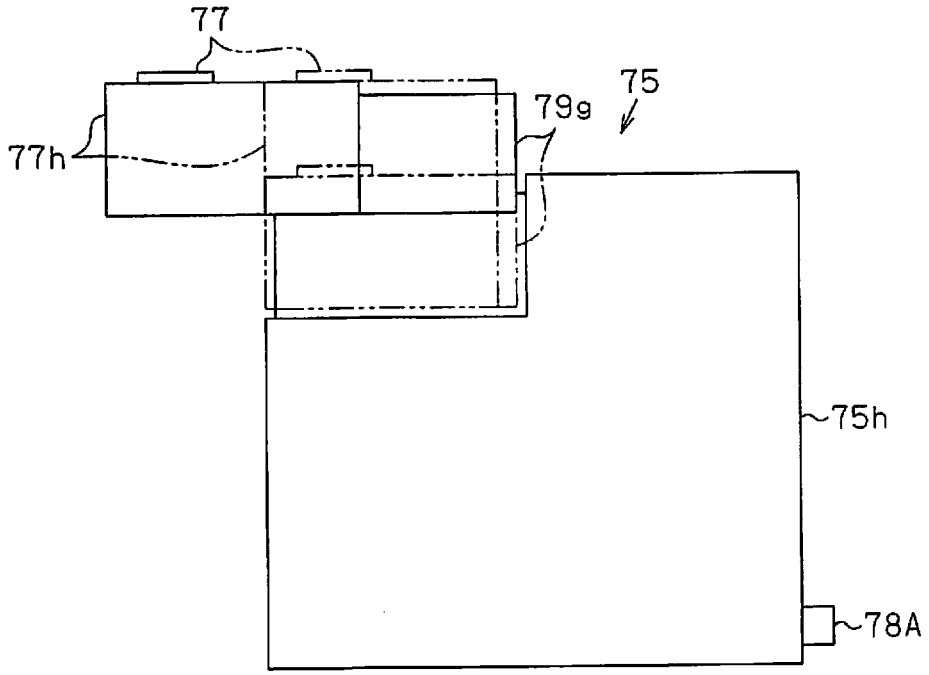

Further, as illustrated in FIG. 17B, the direction of movement of the displacement unit 77*h* and the direction of movement of the displacement unit 77*g* in the process of displacement of the injection ports 77 may be different directions. More specifically, as illustrated by the double-dashed lines and the solid lines in FIG. 17B, the displacement structure may be a structure in which the displacement unit 77*g* is moved linearly to the upper side in the vertical direction Z and thereafter the displacement unit 77*h* is moved linearly in the discharge direction Y. Alternatively, it shall be readily understood that the structure may also be one in which the displacement unit 77*g* and the displacement unit 77*h* can move in an independent manner.

Second Working Example of the Displacement Structure

Figure 18A:
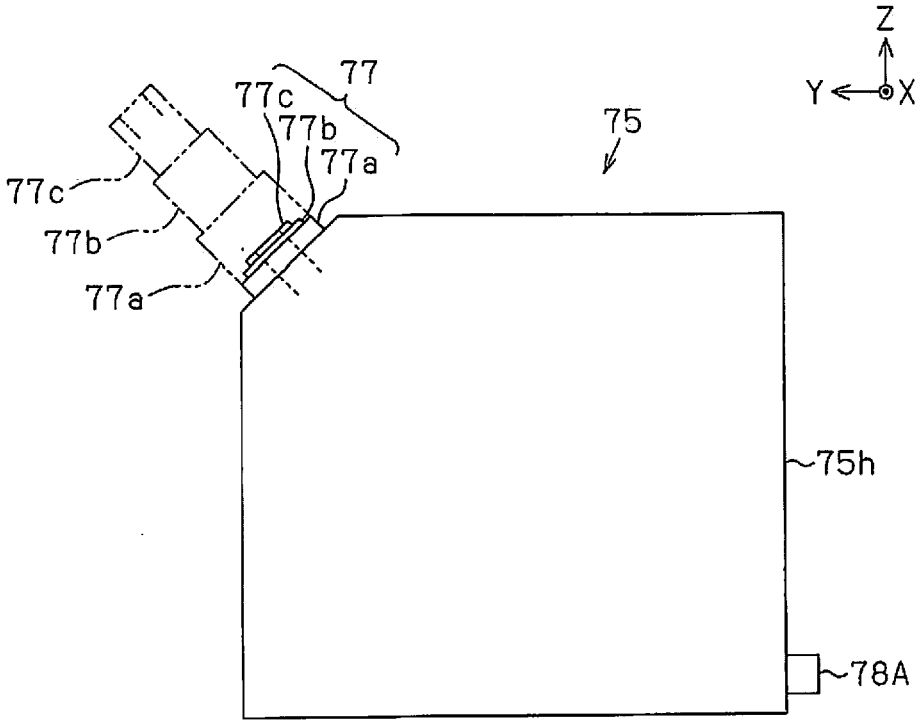
FIGS. 18A and 18B are drawings schematically illustrating a configuration in which the member(s) for forming an injection port is/are extended to displace the injection port, where

As illustrated in FIG. 18A, as regards the displacement structure of the present working example, a displacement unit 77*h* serving as the first portion comprising the injection ports 77 is displaced so as to extend to a tank body part 75*h*, which is the second portion different than the first portion. More specifically, the displacement unit 77*h* is constituted of a plurality (herein, three) of members which can be moved in a relative manner with respect to each other, and the plurality of members, i.e., a first member 77*a*, a second member 77*b*, and a third member 77*c* are included as the first portion comprising the injection ports 77 within the ink tanks 75.

As such, as illustrated by the solid lines and the double-dashed lines in FIG. 18A, movement of the first member 77*a*, the second member 77*b*, and the third member 77*c* in a relative manner with respect to each other makes it possible for the displacement unit 77*h* to be displaced so as to issue forth with respect to the tank body part 75*h*.

Figure 18B:
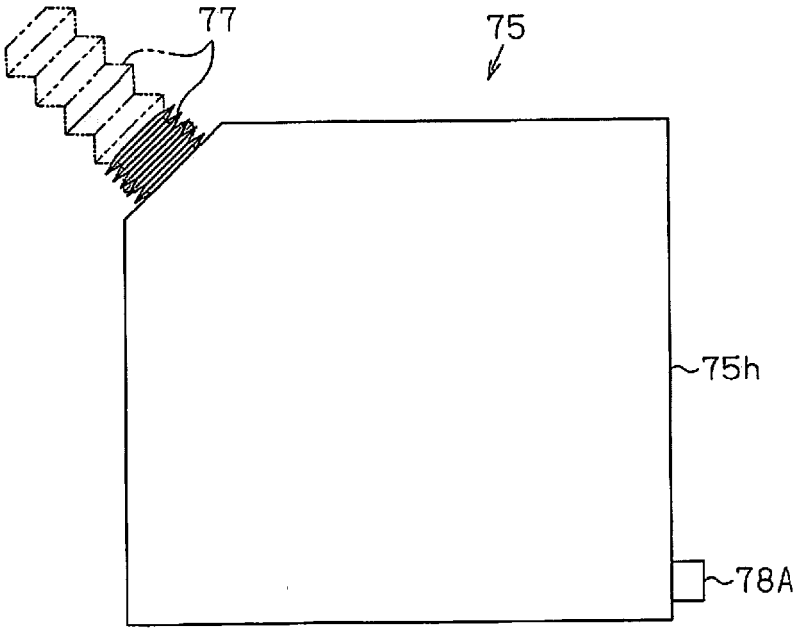

Alternatively, as illustrated in FIG. 18B, the displacement unit 77*h* comprising the injection ports 77 may be formed of a bellows tube provided with a bellows-shaped part that is stretchable. More specifically, as illustrated by the solid lines and the double-dashed lines in FIG. 18A, extension of the bellows-shaped part makes it possible for the displacement unit 77*h* to be displaced so as to issue forth with respect to the tank body part 75*h*.

Third Working Example of the Displacement Structure

Figure 19A:
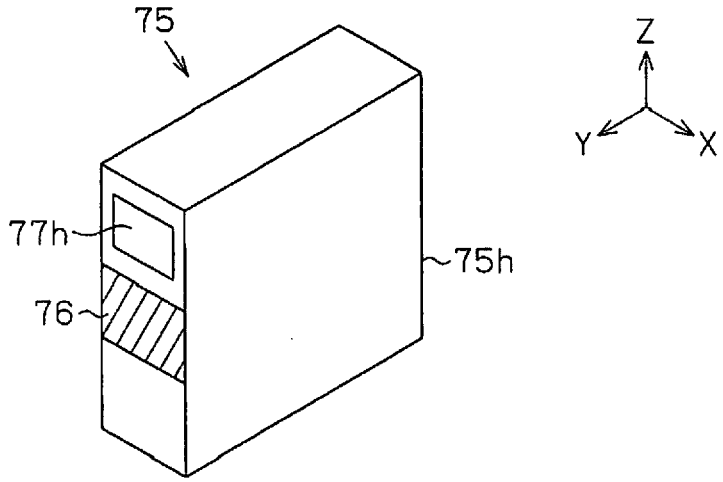
FIGS. 19A-19C drawings illustrating an ink tank capable of displacement from a state where an injection port is not exposed to the exterior to a state where the injection port is exposed to the exterior, where

As illustrated in FIG. 19A, as regards the displacement structure of the present working example, a displacement unit 77*h* serving as the first portion comprising the injection ports 77 is attached in the ink tanks 75 to a tank body part 75*h* serving as the second portion different than the first portion, in a state where the injection ports 77 are not exposed. In the present working example, the displacement unit 77*h* is attached to a front side surface, serving as the discharge direction Y side, of the tank body part 75*h*.

Figure 19B:
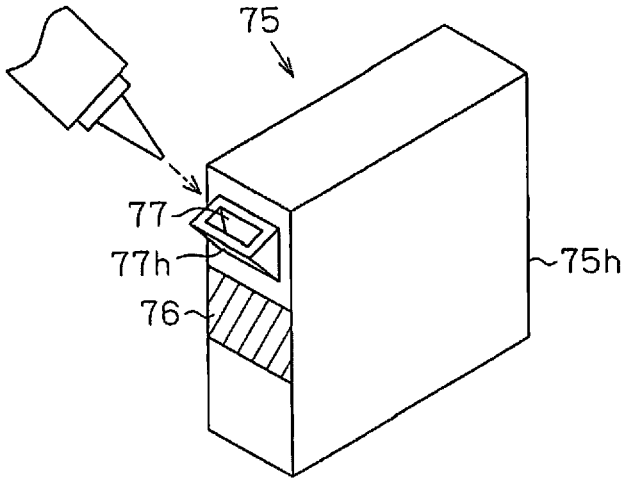

As illustrated in FIG. 19B, the displacement unit 77*h* is configured so as to be able to be displaced, with the upper side moving rotatingly so as to be oriented toward the discharge direction Y about the bottom side, which is the side of the direction of gravity in the vertical direction Z, and this displacement causes the injection ports 77 to be exposed in a state allowing for the ink to be injected to the inside of the ink chamber 75S.

Figure 19C:
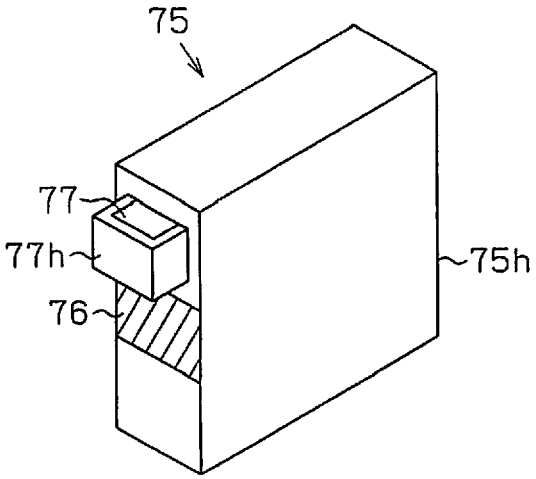

Alternatively, as illustrated in FIG. 19C, the displacement unit 77*h* is configured so as to be able to be displaced linearly moving toward the discharge direction Y side, and this displacement causes the injection ports 77 to be exposed in a state allowing for the ink to be injected to the inside of the ink chamber 75S.

Described next are the effects of the ink tanks 75 of the present embodiment provided with the displacement structure for the injection ports 77.

When looking through the upper surface 75*a* or the lower surface 75*b* (see FIG. 3) of the labels 76 to check for whether there is little remaining of the ink inside of the ink tanks 75, the user displaces the injection ports 77. More specifically, the injection ports 77 are moved by a linear movement, a rotating movement, or the like. This movement causes the injection ports 77 to be exposed in a state allowing for the ink to be injected, and to be displaced to a position at which it is easy to inject the ink. According to the third embodiment described above, it is possible to yield effects as follows.

(15) In the ink tanks 75, it is easy to cause the ink to flow into the ink chamber 75S from the injection ports 77, because the injection ports 77 can be displaced to a position at which the task of injecting the ink is easy.

(16) The ink having been injected from the injection ports 77 can be made to flow into the ink chamber 75S even when the injection ports 77 are displaced to a position at which the task of injecting the ink is easy, because a connection between the injection ports and the ink chamber 75S is established by the interconnecting tubes 97.

(17) There is a greater likelihood that the injection ports 77 can be displaced to a position at which the task of injecting the ink is easy, because the injection ports 77, which are constituted of the plurality of the first member 77*a*, the second member 77*b*, and the third member 77*c* capable of moving in a relative manner with respect to each other, can endow a broader range of motion.

(18) The task of injecting the ink is facilitated because the injection ports 77 are exposed when the ink is to be injected, but the likelihood that foreign matter will enter in from the injection ports 77 is lower, because the injection ports 77 are not exposed to the exterior during non-injection times.

The embodiments described above may be modified as follows. In the third embodiment, a plurality of the injection ports 77 may be provided to one of the ink tanks 75. In other words, a plurality of the ink chambers 75S may be provided to one of the ink tanks 75.

Figure 20A:
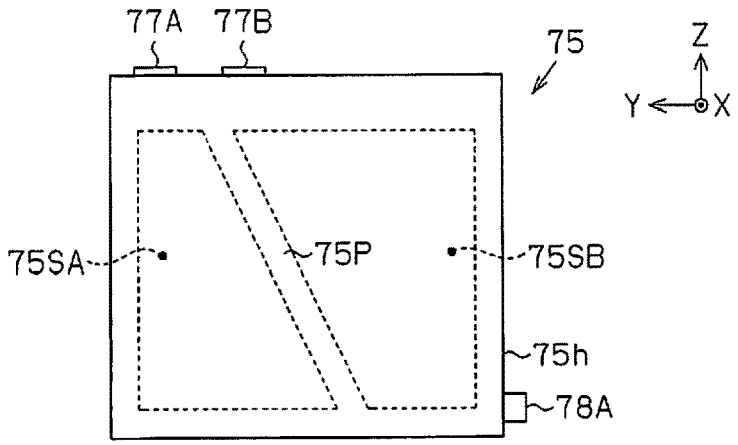
FIGS. 20A-20C are drawings schematically illustrating a configuration of an ink tank having a plurality of injection ports, where

For example, as illustrated in FIG. 20A, there may be two injection ports 77A, 77B provided to one of the ink tanks 75. That is, an ink chamber 75SA and an ink chamber 75SB are formed for an injection port 77A and for an injection port 77B, respectively, in the ink tanks 75. The injection port 7A and the injection port 77B are in close proximity to each other along the discharge direction Y, and are provided closer to one direction (herein, the discharge direction Y side) in the ink tanks 75. This configuration is possible by, for example, providing the ink chamber 75SA and the ink chamber 75B in a shape where one ink chamber is segmented by a partition plate 75P disposed inclined at an ingle within the tank body part 75*h*.

Figure 20B:
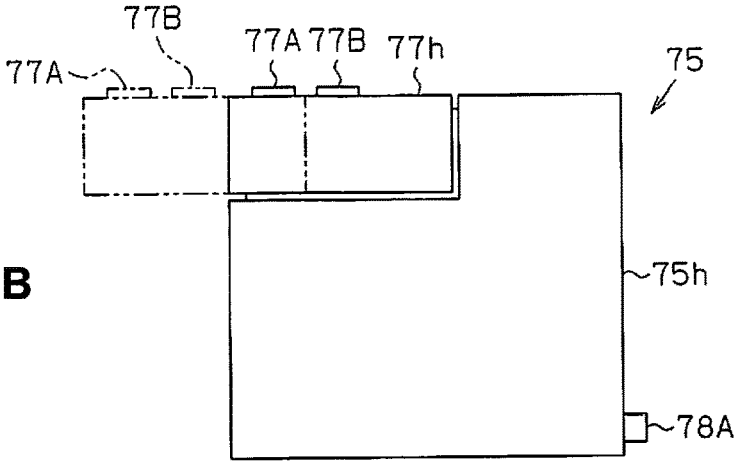

Alternatively, as illustrated in FIG. 20B, the two injection ports 77A, 77B may be provided to the displacement unit 77*h* in the ink tanks 75. The configuration of such description makes it possible for the two injection ports 77A, 77B to be separated toward the discharge direction Y side with respect to the tank body part 75*h* of the ink tanks 75, as illustrated by the double-dashed lines in FIG. 20B.

Figure 20C:
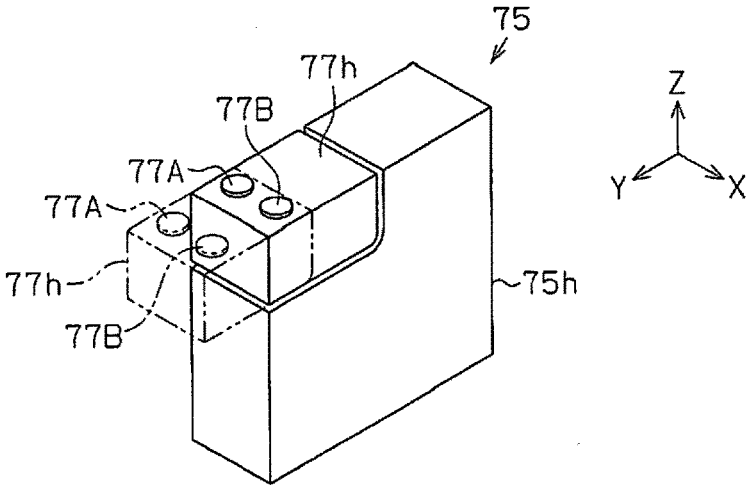

Also, as illustrated in FIG. 20C, the two injection ports 77A, 77B provided to the displacement unit 77*h* may be arranged in parallel along the width direction X, which intersects with the discharge direction Y, in the ink tanks 75. The configuration of such description makes it possible for the two injection ports 77A, 77B to be identically separated toward the discharge direction Y side with respect to the tank body part 75*h* of the ink tanks 75, as illustrated by the double-dashed lines in FIG. 20C.

The ink tanks 75 to which are provided the plurality of injection ports 77, which are a modification example of the third embodiment, may be provided to the printer 11 of the first embodiment. In a case where ink tanks 75 to which are provided, for example, the aforedescribed two injection ports 77A, 77B are provided in the printer 11 of the first embodiment, then the injection ports 77A, 77B are preferably provided to a portion that can be displaced so as to be positioned on the outside of the apparatus case 14 by movement of the ink tanks 75. According to the present modification example, it is possible to yield effects as follows.

(19) In the printer 11, it is possible for the plurality of injection ports 77A, 77B to be displaced to a position at which the task of injecting the ink is easy, because the plurality of injection ports 77A, 77B are positioned on the outside of the apparatus case 14.

The ink tanks 75 to which are provided the plurality of injection ports 77 (77A, 77B), which are a modification example of the third embodiment, may also be provided to the tank unit 70 of the second embodiment. In a case where ink tanks 75 to which are provided, for example, the two injection ports 77A, 77B are provided in the tank unit 70 of the second embodiment, then the injection ports 77A, 77B are preferably provided to a portion that can be moved to the outside of the tank case 79, by displacement of the ink tanks 75 in a relative manner with respect to the tank case 79. According to the present modification example, it is possible to yield effects as follows.

(20) In the tank unit 70, displacement to a position at which the task of injecting the ink is easy is possible, even though a plurality of the injection ports 77 are provided, because the plurality of injection ports 77A, 77B are moved to the exterior of the tank case 79.

The ink tanks 75 of the third embodiment may be provided to the printer 11 of the first embodiment. For example, the ink tanks 75 disclosed by FIG. 2 may be substituted by the ink tanks 75 disclosed by one from among FIG. 16A-16B, 17A-17B, 18A-18B, or 19A-19C. According to this configuration, a printer 11 whereby the injection ports 77 can be displaced to a position at which the task of injecting the ink is easy can be achieved, because the ink tanks 75 whereby the injection ports 77 for the ink can be displaced are provided. As such, in the present modification example, there is not necessarily a need to provide to the printer 11 the movement mechanism (80A to 80E) for the ink tanks 75.

The tank unit 70 of the second embodiment may be provided to the printer 11 of the first embodiment. According to this configuration, a printer 11 whereby the injection ports 77 can be displaced to a position at which the task of injecting the ink is easy can be achieved, because the tank unit 70 whereby the injection ports 77 for the ink can be displaced is provided. As such, in the present modification example, there is not necessarily a need to provide to the printer 11 the movement mechanism (80A to 80E) for the ink tanks 75.

Alternatively, the tank case 79 of the second embodiment may be substituted by the tank holder 72 provided inside the spatial region enclosed by the apparatus case 14 of the first embodiment. For example, the tank unit 70 disclosed by any one from among FIG. 13A, 14, or 15 could be substituted with the tank holder 72, the ink tanks 75, and the movement mechanism 80A disclosed in FIG. 5. According to this configuration, the structure for moving the first portion of the ink tanks 75 is simpler, and the chassis of the printer 11 can be reduced in size.

Alternatively, for example, the tank unit 70 disclosed in FIG. 13C could be substituted with the tank holder 72, the ink tanks 75, and the movement mechanism 80A disclosed in FIG. 5. In such a case, the upper surface of the tank unit 70 is exposed by opening the scanner unit 70 in a case where the scanner unit 13 is included, as with the printer 11 disclosed in FIG. 1. At this time, the ink tanks 75 are pushed in the downward direction, and are elevated by the urging member CS, whereby the first portion of the ink tanks 75 is moved and the injection ports 77 can be displaced to a position at which the task of injecting the ink is easy. According to this configuration, the structure for moving a part of the ink tanks 75 is simpler, and the chassis of the printer 11 can be reduced in size.

In the tank unit 70 of the second embodiment, the injection ports 77 of the ink tanks 75 need not necessarily be displaced to the outside of the tank case 79, provided that the position be one at which the ink can be injected. More specifically, in the second embodiment, a state of having moved to the outside of the tank case 79 includes at least a part of the injection ports 77 is moved to the outside of the tank case 79.

In the tank unit 70 of the second embodiment, the ink tanks 75 need not necessarily be provided on the inside of the tank case 79 during a non-injection time (ordinary usage state) where ink is not being injected. More specifically, the holding structure for the ink tanks 75 may be a configuration for moving the injection ports 77 in a relative manner with respect to the tank case 79, and displacing same from a position at which injection of the ink is difficult to a position at which injection of the ink is easy.

In the first embodiment, the see-through region 16T serving as a viewing unit need not necessarily be provided to the front cover 16. For example, in a case where the ink tanks 75 are to be replenished with the ink on a regular basis, then there is no particular need to check the amount of ink remaining from the see-through region.

In the first embodiment, the medium is not limited to being the sheet of paper P, but rather may be a metal sheet, a resin sheet, or a sheet-shaped member made of a material of a cloth material or the like. More specifically, any medium can be employed provided that the medium can be conveyed and is a member allowing for printing using ink that is consumed by the liquid ejection unit 20.

In the first embodiment, the liquid ejection unit 20 is not limited to a serial-type printer in which the liquid ejection head 22 moves reciprocatingly in association with the carriage 21, but rather may also be a line head-type printer in which a maximum-width range of a sheet of paper can be printed even while the liquid ejection head 22 remains fixed.

In the first embodiment, the printer 11 may be an apparatus not provided with the scanner unit 13, or may be a multifunction peripheral provided with a functionality such as a fax apparatus or a copy apparatus, together with the liquid ejection unit 20.

In the first embodiment, the liquid ejecting apparatus was specifically represented by an inkjet-type printer 11 provided with a liquid ejection head for ejecting ink, but another specific representation may also be a liquid ejecting apparatus for ejecting or discharging a liquid other than ink. It would be possible to appropriate a variety of liquid ejecting apparatuses provided with a liquid ejection head for discharging micro-sized liquid droplets, or the like. The phrase "liquid droplets" refers to the state of a liquid that is discharged from the liquid ejecting apparatus, and is understood to also include a liquid that leaves a particulate, tear-shaped, or filamentous trail. The phrase "liquid" as stated herein should be such a material that the liquid ejecting apparatus is able to eject the material. For example, a "liquid" is a state of when a substance is a liquid phase, and the phrase "liquid" also includes highly- or poorly-viscous liquid-state materials, as well as sols, gel waters, and other such liquid-state materials as inorganic solvents, organic solvents, solutions, liquid-state resins, and liquid-state metals (metallic melts), and includes not only liquids as one state of a substance, but also solvents in which particles of a functional material comprising solid matter such as metal particles or a pigment are dissolved, dispersed, or mixed. Representative examples of liquids include ink, as was described in the embodiments above, as well as liquid crystal and the like. Herein, the term "ink" encompasses a variety of compositions in the form of a liquid, such as general water-soluble ink and oil-soluble ink as well as gel ink, hot melt ink, and the like. One specific example of a liquid ejecting apparatus would be a liquid ejecting apparatus for ejecting a material such as a colorant or an electrode material used, inter alia, in the production of, for example, a liquid crystal display, electroluminescence (EL) display, a surface-emitting display, or a color filter, in a dispersed or dissolved form. Alternatively, it may be a liquid ejecting apparatus for ejecting bio-organic matter used in the production of biochips, a liquid ejecting apparatus for ejecting a liquid serving as a test sample, used as a precision pipette, or a printing apparatus, microdisplay, or the like. It may also be: a liquid ejecting apparatus for ejecting a lubricating oil at pinpoints onto precision machinery, such as a timepiece or camera; a liquid ejecting apparatus for ejecting onto a substrate a translucent resin liquid, such as an ultraviolet-curing resin, for forming a hemispherical microlens (an optical lens) or the like used in an optical communication element or the like; or a liquid ejecting apparatus for ejecting an etching solution, such as an acid or an alkali, in order to etch a substrate or the like. The present invention can be applied to any of these types of liquid ejecting apparatuses.

A liquid container according to the illustrated embodiment(s) is able to communicate via a liquid supply member to a liquid ejection head of a liquid ejecting apparatus, wherein: an injection port for a liquid; a liquid containing portion capable of containing the liquid injected thereinto from the injection port; and a supply port capable of connecting to the liquid supply member are provided, a first portion of the liquid container including the injection port being displaceable in a relative manner with respect to a second portion of the liquid container which is different than the first portion and includes the liquid containing portion.

According to this configuration, in the liquid container, the liquid can be easily made to flow into the inside of the liquid containing portion from the injection port, because the injection port can be displaced to a position at which the task of injecting the liquid is easy.

In the liquid container, preferably, the first portion is slideable in a relative manner with respect to the second portion.

In the liquid container, preferably, the first portion and the second portion are in communication to each other by a tube, and the liquid having been injected from the injection port flows through the inside of the tube and is injected into the liquid containing portion.

According to this configuration, the liquid having been injected from the injection port can be easily made to flow to the inside of the liquid containing portion, even when the first portion comprising the injection port is displaced to a position at which the task of injecting the liquid is easy.

In the liquid container, preferably, the first portion is constituted of a plurality of members which are displaceable in a relative manner with respect to each other.

According to this configuration, there is a greater likelihood that the injection port can be displaced to a position at which the task of injecting the liquid is easy, because the movement of the plurality of members broadens the range of motion of the injection port.

In the liquid container, preferably, the first portion is rotatingly moveable in a relative manner with respect to the second portion.

In the liquid container, preferably, there are a plurality of the injection ports provided, as well as a plurality of the liquid containing portions corresponding to the injection ports, and the plurality of injection ports for injecting the liquid into the plurality of liquid containing portions are provided to the first portion which is displaceable in a relative manner with respect to the other portion within the liquid container.

According to this configuration, the plurality of injection ports can be displaced to a position at which the task of injecting the liquid is easy, even though there are a plurality of the injection ports provided.

In the liquid container, preferably, the displacement of the first portion displaces the injection ports in the liquid container from a state of not being exposed to the exterior to a state of being exposed to the exterior.

According to this configuration, the task of injecting the liquid is facilitated, because the injection ports are exposed when the liquid is to be injected, but in turn there is a lower likelihood that foreign matter will enter from the injection ports, because the injection ports are not exposed to the exterior at times of non-injection.

A liquid container unit according to the illustrated embodiment(s) is provided with: a liquid container having an injection port for a liquid; a liquid containing portion capable of containing the liquid injected from the injection port; and a supply port capable of connecting to a liquid supply member in communication to a liquid ejection head of a liquid ejecting apparatus; and a container holder capable of holding the liquid container; the container holder holding the liquid container in a state where a first portion comprising at least the injection port in the liquid container is displaceable in a relative manner with respect to the container holder.

According to this configuration, in the liquid container unit, the liquid can be easily made to flow to the inside of the liquid containing portion from the injection port, because displacement of the first portion comprising the injection port with respect to the container holder causes the injection port to be displaced to a position at which the task of injecting the liquid is easy.

In the liquid container unit, preferably, the container holder holds the liquid container in a slideable manner, whereby at least the first portion of the liquid container enters a state of being displaceable in a relative manner with respect to the container holder.

According to this configuration, in the liquid container unit, the injection port can be displaced to a position at which the task of injecting the liquid is easy, by a minimum distance of movement by the liquid container.

In the liquid container unit, preferably, the container holder holds the liquid container so as to enable linear movement along a guide rail provided to the container holder.

According to this configuration, in the liquid container, the liquid container can be easily moved in a linear manner along the guide rail.

In the liquid container unit, preferably, the container holder holds the liquid container so as to enable rotating movement, whereby at least the first portion of the liquid container enters a state of being displaceable in a relative manner with respect to the container holder.

According to this configuration, in the liquid container unit, it is possible to displace the injection port to a position at which the task of injecting the liquid is easy, by a rotating movement, which is a movement that can be achieved by a relatively simple structure.

In the liquid container according to the illustrated embodiment(s), the first portion of the liquid container is displaceable in a relative manner with respect to a second portion of the liquid container which is different than the first portion and includes the liquid containing portion, and the first portion is slideable in a relative manner with respect to the second portion.

In the liquid container unit, preferably, the first portion of the liquid container is displaceable in a relative manner with respect to a second portion of the liquid container which is different than the first portion and includes the liquid containing portion, and the first portion is constituted of a plurality of members which are displaceable in a relative manner with respect to each other.

In the liquid container unit, preferably, the first portion of the liquid container is displaceable in a relative manner with respect to a second portion of the liquid container which is different than the first portion and includes the liquid containing portion, and the first portion is rotatingly moveable in a relative manner with respect to the second portion.

In the liquid container unit, preferably, the first portion comprising the injection port is a portion whereby the injection port can be moved from the interior of the container holder to the exterior of the container holder, by being displaced in a relative manner with respect to the container holder.

According to this configuration, the injection port can be displaced to a position at which the task of injecting the liquid is easy, because the injection port enters a state of having moved from the interior of the container holder to the exterior thereof when the first portion comprising the injection port in the liquid container is displaced.

In the liquid container unit, preferably, there are a plurality of the injection ports provided to the liquid container, as well as a plurality of the liquid containing portions corresponding to the injection ports, and the plurality of injection ports for injecting the liquid into the plurality of liquid containing portions are provided to a portion which is moveable to the outside of the container holder by being displaced in a relative manner with respect to the container holder.

According to this configuration, in the liquid container unit, the plurality of injection ports can be displaced to a position at which the task of injecting the liquid is easy, because the plurality of injection ports are moved to the exterior of the container holder in a case where a plurality of the injection ports are provided to one single liquid container.

In the liquid container unit, preferably, the container holder holds the liquid container in a state where a first portion comprising at least the injection ports in the liquid container is displaceable in a relative manner with respect to the container holder, after the liquid container is moved in a direction opposite to the direction of movement when the injection ports are being moved to the outside of the container holder.

According to this configuration, in the liquid container unit, faulty displacement of the injection ports is curbed, because, for example, pushing on the liquid container to move same in the direction inverse to the direction of displacement of the injection ports allows a user to displace the injection ports to a position at which the task of injecting the liquid is easy.

In the liquid container unit, preferably, an elastically deformable tube for supplying the liquid to the exterior from the liquid containing portion is connected to the liquid container, and a curved part which is curved in a natural state is formed in the tube, at a tube portion positioned on the inside of the container holder.

According to this configuration, in the liquid container unit, deterioration of the tube is curbed and the liquid can be supplied from the liquid container in a stabilized manner, because of suppression so as to prevent bending stress from being applied to the tube in a state of being held by the container holder.

In the liquid container unit, preferably, an electrical connection unit that enables an electrical connection between the liquid container and the container holder is provided, and the container holder holds the liquid container so that a first portion comprising at least the injection ports in the liquid container is displaceable in a relative manner with respect to the container holder in a state where an electrical connection with the liquid container is established at the electrical connection unit.

According to this configuration, an electrical signal relating to, for example, the liquid being injected can be transmitted to the container holder side during the task of injecting the liquid from the injection ports.

A liquid ejecting apparatus according to the illustrated embodiment(s) is provided with: a liquid ejection head that ejects a liquid; a liquid container, comprising an injection port for a liquid, a liquid containing portion capable of containing the liquid injected from the injection port, the liquid containing portion being provided so as to correspond to the injection port, and a supply port capable of connecting to a liquid supply member in communication to the liquid ejection head; and a chassis that contains the liquid container and the liquid ejection head; wherein the chassis contains at least a part of the liquid container in a state where a first portion comprising at least the injection port in the liquid container is displaceable in a relative manner with respect to the chassis.

According to this configuration, in the liquid ejecting apparatus, it is easy to cause the liquid to flow into the liquid containing portion from the injection port, because when a cover member is placed in the uncovered state, the first portion of the liquid container can be moved so that, for example, the injection port is displaced to a position at which the task of injecting the liquid is easy.

In the liquid ejecting apparatus, preferably, the chassis holds the liquid container so as to enable sliding, whereby at least the first portion of the liquid container enters a state of being displaceable in a relative manner with respect to the chassis.

In the liquid ejecting apparatus, preferably, the chassis holds the liquid container so as to enable rotating movement, whereby at least the first portion of the liquid container enters a state of being displaceable in a relative manner with respect to the chassis.

In the liquid ejecting apparatus, preferably, the first portion of the liquid container is displaceable in a relative manner with respect to a second portion of the liquid container which is different than the first portion and includes the liquid containing portion, and the first portion is slideable in a relative manner with respect to the second portion.

In the liquid ejecting apparatus, preferably, the first portion of the liquid container is displaceable in a relative manner with respect to a second portion of the liquid container which is different than the first portion and includes the liquid containing portion, and the first portion is constituted of a plurality of members which are displaceable in a relative manner with respect to each other.

In the liquid ejecting apparatus, preferably, the first portion of the liquid container is displaceable in a relative manner with respect to a second portion of the liquid container which is different than the first portion and includes the liquid containing portion, and the first portion is rotatingly moveable in a relative manner with respect to the second portion.

In the liquid ejecting apparatus, preferably, a cover member capable of opening or closing off an opening part provided so as to correspond to the liquid container is provided to the chassis, and also provided is a movement mechanism that displaces the first portion of the liquid container from the inside of the chassis to the outside of the chassis via the opening part, in conjunction with a motion where the cover member is moved from a closed state where the opening part is closed off to an uncovered state where the opening part is open.

In the liquid ejecting apparatus, preferably, the movement mechanism displaces the first portion comprising at least the injection port in the liquid container from the inside of the chassis to the outside of the chassis via the opening part in conjunction with the movement of the cover member.

According to this configuration, in the liquid ejecting apparatus, the injection port can be quickly displaced to a position at which the task of injecting the liquid is easy, simultaneously with, for example, the cover member entering the uncovered state, because the first portion comprising at least the injection port is displaced in conjunction with the movement of the cover member.

In the liquid ejecting apparatus, preferably, the movement mechanism displaces the first portion comprising at least the injection port in the liquid container from the inside of the chassis to the outside of the chassis via the opening part, by linearly moving the liquid container.

According to this configuration, in the liquid ejecting apparatus, the injection port can be displaced to a position at which the task of injecting the liquid is easy, by a minimum distance of movement by the liquid container.

In the liquid ejecting apparatus, preferably, the movement mechanism displaces the first portion comprising at least the injection port in the liquid container from the inside of the chassis to the outside of the chassis via the opening part, by rotatingly moving the liquid container.

According to this configuration, in the liquid ejecting apparatus, it is possible to displace the injection port to a position at which the task of injecting the liquid is easy, by a rotating movement, which is a movement that can be achieved by a relatively simple structure.

In the liquid ejecting apparatus, preferably, there are a plurality of the injection ports provided to the liquid container, as well as a plurality of the liquid containing portions corresponding to the injection ports, and the plurality of injection ports for injecting the liquid into the plurality of liquid containing portions are provided to a portion which is displaceable so as to be positioned on the outside of the chassis by a movement of the liquid container.

According to this configuration, in the liquid ejecting apparatus, the plurality of injection ports can be displaced to a position at which the task of injecting the liquid is easy, because the plurality of injection ports are positioned on the outside of the chassis.

In the liquid ejecting apparatus, preferably, an elastically deformable tube for supplying the liquid from the liquid containing portion to the liquid ejection unit is connected to the liquid container, and a curved part which is curved in a natural state is formed at least in part in the tube.

According to this configuration, in the liquid ejecting apparatus, deterioration of the tube is curbed and the liquid can be supplied from the liquid container in a stabilized manner, because of suppression so as to prevent bending stress from being applied to the tube in a state of being connected to the liquid container.

In the liquid ejecting apparatus, preferably, an electrical connection unit that enables an electrical connection between the liquid container and the chassis is provided, and at least a part of the first portion is displaceable from the inside of the chassis to the outside of the chassis in a state where an electrical connection with the chassis is established at the electrical connection unit.

According to this configuration, an electrical signal relating to, for example, the liquid being injected can be transmitted to the chassis side (the liquid ejecting apparatus side) during the task of injecting the liquid from the injection ports.

A liquid ejecting apparatus according to the illustrated embodiment(s) is provided with a liquid container having an above-described configuration, and a liquid ejection head for ejecting the liquid.

According to this configuration, a liquid ejecting apparatus whereby the injection ports can be displaced to a position at which the task of injecting the liquid is easy can be achieved, because the liquid container whereby the injection ports for the liquid can be displaced is provided.

A liquid ejecting apparatus according to the illustrated embodiment(s) is provided with a liquid container unit having an above-described configuration, and a liquid ejection head for ejecting the liquid.

According to this configuration, a liquid ejecting apparatus whereby the injection ports can be displaced to a position at which the task of injecting the liquid is easy can be achieved, because the liquid container unit whereby the injection ports for the liquid can be displaced is provided.

The invention claimed is:

1. A liquid ejecting apparatus comprising:

a liquid tank including a liquid injection port, a liquid containing portion containing the liquid injected from the liquid injection port, and a supply port supplying the liquid;

a tank holder holding the liquid tank;

a liquid ejection head that ejects a liquid supplied from the supply port; and an apparatus casing accommodating the liquid tank, the tank holder, and the liquid ejection head, the apparatus casing being a separate member from the tank holder, the apparatus casing having an opening part and an openable and closable front cover covering the opening part on a front side, the opening part and the front cover being provided so as to correspond to the liquid tank, wherein the tank holder is housed within the apparatus casing, and is pivotable relative to the apparatus casing while holding the liquid tank in conjunction with opening and closing of the front cover, and the liquid injection port of the liquid tank is configured to be exposed to an exterior of the apparatus casing from the front side of the apparatus casing via the opening part by simultaneously opening the front cover and pivoting the tank holder relative to the apparatus casing to inject the liquid into the liquid tank, while the liquid tank is held in the tank holder.

2. The liquid ejecting apparatus according to claim 1, wherein the liquid ejecting apparatus further comprises a movement mechanism that displaces the tank holder to pivot relative to the apparatus casing in conjunction with a motion where the front cover is opened and closed.

3. The liquid ejecting apparatus according to claim 1, further comprising an electrical connector that establishes an electrical connection between the liquid tank and the apparatus casing, wherein the tank holder is pivotable relative to the apparatus casing in a state where the electrical connection between the liquid tank and the apparatus casing is established by the electrical connector.

4. The liquid ejecting apparatus according to claim 1, wherein the liquid injection port of the liquid tank is disposed on an outside of the apparatus casing after the tank holder is pivoted relative to the apparatus casing in conjunction with opening of the front cover.

* * * * *